US006008165A

United States Patent [19]

Shanklin et al.

[11] Patent Number: 6,008,165

[45] Date of Patent: Dec. 28, 1999

[54] ALCOHOL BORATE ESTERS AND BORATED DISPERSANTS TO IMPROVE BEARING CORROSION IN ENGINE OILS

[75] Inventors: James R. Shanklin, Concord; Carl F. Stachew, Wickliffe, both of Ohio

[73] Assignee: The Lubrizol Corporation, Wickliffe, Ohio

[21] Appl. No.: 09/127,471

[22] Filed: Jul. 31, 1998

[51] Int. Cl.[6] ..... C10M 141/02; C10M 141/12

[52] U.S. Cl. ..... 508/185; 508/287; 508/368; 508/371; 508/372; 508/391; 508/375; 508/460; 508/542; 508/574

[58] Field of Search ..... 508/185, 287, 508/368, 371, 372, 375, 391, 460, 542, 574

[56] References Cited

U.S. PATENT DOCUMENTS

| | | | |
|---|---|---|---|
| 3,087,936 | 4/1963 | LeSuer | 260/326.3 |
| 3,125,526 | 3/1964 | Siegart | 508/185 |
| 3,125,528 | 3/1964 | Kay et al. | 508/185 |
| 4,440,656 | 4/1984 | Horodysky | 508/185 |
| 4,522,734 | 6/1985 | Horodysky et al. | 508/185 |
| 4,533,481 | 8/1985 | Jahnke | 508/185 |
| 4,741,848 | 5/1988 | Koch et al. | 252/49.6 |
| 4,842,755 | 6/1989 | Dunn | 508/185 |
| 4,859,353 | 8/1989 | Colclough | 252/46.3 |
| 5,078,893 | 1/1992 | Ryer et al. | 252/49.6 |
| 5,320,765 | 6/1994 | Fetterman, Jr. et al. | 508/518 |
| 5,334,329 | 8/1994 | Vinci et al. | 252/49.6 |
| 5,451,333 | 9/1995 | Waddoups et al. | 508/539 |
| 5,486,300 | 1/1996 | Solomon et al. | 508/518 |
| 5,498,355 | 3/1996 | Perozzi et al. | 508/454 |
| 5,558,802 | 9/1996 | Dowling | 508/518 |
| 5,612,295 | 3/1997 | Bell et al. | 508/188 |
| 5,698,498 | 12/1997 | Luciani et al. | 508/193 |
| 5,719,107 | 2/1998 | Outten et al. | 508/185 |

*Primary Examiner*—Jacqueline V. Howard
*Attorney, Agent, or Firm*—James L. Cordek; Joseph P. Fischer

[57] ABSTRACT

1. A composition for reducing the copper-lead bearing corrosion of a formulation that includes a major amount of an oil of lubrication viscosity and a minor amount of a corrosion-reducing additive comprising (A) a borated dispersant with a total base number of from 20 to 160 on an oil-free basis;

(B) a metal salt of a phosphorus acid; and (C) a metal overbased composition comprising at least one carboxylate, phenate, or sulfonate wherein the metal is lithium, sodium, potassium, magnesium or calcium, and wherein the improvement comprises (D) a borate ester.

The borated ester and borated dispersant provide from 20 to about 800 parts per million (ppm) mass of boron in the composition.

36 Claims, No Drawings

ALCOHOL BORATE ESTERS AND BORATED DISPERSANTS TO IMPROVE BEARING CORROSION IN ENGINE OILS

FIELD OF THE INVENTION

The present invention relates to a lubricating oil composition that improves the copper-lead bearing corrosion of an engine. The lubricating oil composition contains a borated dispersant, a metal salt of a phosphorus acid, a metal overbased composition and a borate ester.

BACKGROUND OF THE INVENTION

Lubricating compositions having utility as engine oil formulations typically contain dispersants, detergents, antiwear agents and anti-foamants as well as other types of lubricants. Lubricating oil compositions of this type typically control sludge and varnish formation and, in general, promote good engine life. No one typical lubricating oil composition necessarily solves all the deleterious effects known to occur with an automotive engine.

A lubricating oil composition that performs adequately in one engine at given operating conditions does not necessarily perform adequately when used in a different engine or under different conditions. While theoretically, lubricants could be designed for each possible combination of engine and seivice condition, such a strategy would be unpracticable because many different types of engines exist and the engines are used under different conditions. Accordingly, lubricants that perform well in different types of engines and across a broad spectrum of conditions (e.g., fuel type, operating load and temperature) are desired. Design of lubricating oil compositions is further complicated in that the concentrated mixture of chemicals added to lubricating oil base stocks to import desirable properties should perform well over a broad range of different quality base stocks. Meeting these requirements has been extremely difficult because the formulations are complicated, tests to ascertain whether a lubricant performs well are extremely expensive and time consuming, and collecting field test data is difficult since variables cannot be sufficiently controlled.

U.S. Pat. No. 3,087,936 (LeSuer, Apr. 30, 1963) relates to a process for preparing oil-soluble nitrogen- and boron-containing compositions comprising treating an acylated nitrogen composition characterized by the presence within its structure of (A) a substantially hydrocarbon substituted succinic radical selected from the class consisting of succinoyl, succinimidoyl, and succinoyloxy radicals wherein the substantially hydrocarbon substituent contains at least 50 aliphatic carbon atoms and (B) a nitrogen-containing group characterized by a nitrogen atom attached directly to said succinic radical, with a boron oxide, boron halides, boron acids, and esters of bcoron acids in an amount to provide from about 0.1 atomic proportion of boron for each mole of said acylated nitrogen composition to about 10 atomic proportions of boron for each atomic proportion of nitrogen of said acylated nitrogen composition.

U.S. Pat. No. 4,741,848 (Koch et al., May 3, 1988) relates to a process which comprises reacting (A) at least one hydroxy-substituted ester, amide, or imide of the formula

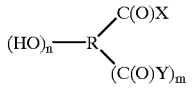

wherein R is a divalent hydrocarbyl group, X is —OR' or —NR'R", wherein R' is a hydrocarbyl group and R" is hydrogen or a hydrocarbyl group, Y is OH or X, m is zero to 2, or X and one Y taken together represent a single NR' group forming a cyclic imide, and n is an integer from 1 to 10 provided that only one free hydroxyl group is attached per carbon atom of the hydrocarbyl group R, with (B) a boron compound selected from the group consisting of boric acid, boron trioxide, boron halides, boron amides and boron esters.

U.S. Pat. No. 4,859,353 (Colclough, Aug. 22, 1989) provides for sulfur containing borate esters of the formula

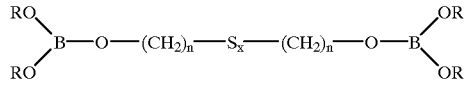

(wherein each R is a hydrocarbyl group optionally substituted by one or more —XR" group, or the two R groups attached to one boron represent a group $—(R'_2C)_m$, x is from 1 to 4, each n is from 1 to 6, each m is from 2 to 4 and each R' is hydrogen, an —XR" group, or a hydrocarbyl radical optionally substituted by one or more —XR" group, X is O, S or NR" or two groups R' together form an alicyclic or heterocyclic ring, and R" is hydrogen, a hydrocarbyl radical or a hydrocarbyl-carbonyl group) and mixtures and polymeric forms thereof.

U.S. Pat. No. 5,078,893 (Ryer et al., Jan. 7, 1992) relates to a mutually compatible combination of additives and their use to impart antiwear, oxidation inhibition and friction modification to power transmission compositions, particularly automatic transmission fluids. The additives comprise an organic phosphite ester such as triphenyl phosphite and a hydroxyl amine compound, such as that having the formula

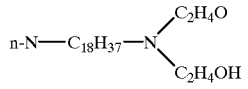

preferably in combination with a dispersant such as a polyisobutenyl succinimide or a borated derivative thereof.

U.S. Pat. No. 5,334,329 (Vinci et al., Aug. 2, 1994) describes a lubricating composition which comprises a mixture of (A) a major amount of an oil of lubricating viscosity, (B) a dispersant effective amount of at least one ashless dispersant, and (C) a minor, effective amount of at least one demulsifier characterized by the formula

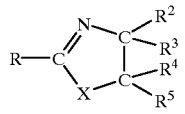

wherein R is a hydrocarbyl group, $R^2$, $R^3$, $R^4$ and $R^5$ are each independently hydrogen or hydrocarbyl groups, and X is oxygen or NR' wherein R' is hydrogen or a hydrocarbyl group. In one embodiment, the dispersant (B) is a boron-containing composition.

U.S. Pat. No. 5,612,295 (Bell et al., Mar. 18, 1997) relates to multifunctional additive compositions formed by a process which comprises heating concurrently or in any sequence (a) an oil-soluble ashless dispersant containing basic nitrogen with (b) an alkoxylated alcohol of at least 8 carbon atoms and (c) a borating agent to a temperature in the range of about 50° to about 150° C., and if water and/or solids are present in the resultant mixture, removing both of them or whichever of them is present in the resultant mixture. These additives, once prepared and filtered, are clear mixtures that tend to remain free of haze and solids even after long periods of storage at elevated temperatures such as 70° C., even though they may contain high levels of boron within the range of proportions described hereafter.

U.S. Pat. No. 5,698,498 (Luciani et al., Dec. 16, 1997) relates to a lubricating composition comprising a major amount of an oil of lubricating viscosity and (A) a minor amount of at least one hydroxyalkyl dithiocarbamate or at least one borate thereof wherein the dithiocarbamate is derived from an amine other than an alkyl or alkenyl succinimide. In another aspect, this reference relates to a lubricating composition comprising a major amount of an oil of lubricating viscosity, a hydroxyalkyl dithiocarbamate or a borate thereof, and (B) at least one sulftir compound or (C) at least one phosphorus or boron antiwear or extreme pressure agent. The lubricants and fluids have improved antiwear and extreme pressure properties including improved antiscuff protection.

SUMMARY OF THE INVENTION

Disclosed is a composition for reducing the copper-lead bearing corrosion of a formulation that includes a major amount of an oil of lubrication viscosity and a minor amount of a corrosion-reducing additive comprising (A) a borated nitrogen containing-dispersant with a total base number of from 20 to 160 on an oil-free basis;

(B) a metal salt of a phosphorus acid; and (C) a metal overbased composition comprising at least one carboxylate, phenate, or sulfonate wherein the metal is lithium, sodium, potassium, magnesium or calcium, and wherein the improvement comprises (D) a borate ester.

The borate ester and borated dispersant provide fiom 20 to about 800 parts per million (ppm) mass of boron in the composition.

DETAILED DESCRIPTION OF THE INVENTION

Oil of Lubrication Viscosity

The diverse oils of lubricating viscosity include natural and synthetic lubricating oils and mixtures thereof. These lubricants include crankcase lubricating oils for spark-ignited and compression-ignited internal combustion engines, including automobile anrd truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes, poly(1-octenes), poly(1-decenes), etc. and mixtures thereof]; alkylbenzenes (e.g., dodecylbenzenes, tetradecylbenzenes, dinonylbenzenes, di(2-ethylhexyl)-benzenes, etc.]; polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and intelpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1,000, diphenyl ether of polyethylene glycol having a molecular weight of 500–1,000, diethyl ether of polypropylene glycol having a molecular weight of 1,000–15,000, etc.) or mono- and polycarboxylic esters thereof, for example, the acetic acid esters, mixed $C_3$–$C_8$ fatty acids esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alicyl malonic acids, alkenyl malonic acids, etc.) with a variety of alcohols (e.g., butyl alcohol, hexyl alcohol, docecyl alcohol, 2-ethylhexyl alcohol, ethylene glycol, diethylene glycol monoether, propylene glycol, etc.). Specific examples of these esters include dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxysiloxane oils, and silicate oils comprise another useful class of synthetic lubricants (e.g., tetraelbhyl silicate, tetraiosopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)-disiloxane, poly(methyl) siloxanes, poly(-methylphenyl) siloxanes, etc.). Other synthetic lubricating oils include liquid esters of phosphorus-containing acids (e.g., tricresyl phosphate, trioctyl phosphate, diethyl ester of decane phosphononic acid, etc.) polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

The aliphatic and alicyclic substituents, as well as aryl nuclei, are generally described as "hydrocarbon-bases". The meaning of the term "hydrocarbon-based as used herein is apparent from the following detailed discussion of "hydrocarbon-based substituent".

As used herein, the term "hydrocarbon-based substituent" denotes a substituent having a carbon atom directly attached to the remainder of the molecule and having predominantly hydrocarbyl character within the context of this invention. Such substituents include the following:

(1) Hydrocarban substituents, that is aliphatic (e.g., alkyl or alkenyl), alicyclic (e.g., cycloalkyl or cycloalkenyl) substituents, aromatic, aliphatic- and alicyclic-substituted aromatic nuclei and the like, as well as cyclic substituents wherein a ring is completed through another portion of the molecule.

(2) Substituted hydrocarbon substituents, that is, those containing non-hydrocarbon radicals which, in the context of this invention, do not alter the predominantly hydrocarbyl character of the substituent. Those skilled in the art will be aware of suitable radicals (e.g., hydroxy, halo, (especially chloro and fluoro), alkoxyl, mercapto, alkyl mercapto, nitro, nitroso, sulfoxy, etc., radicals).

(3) Hetero sulstituents, that is, substituents which, while predominantly hydrocarbon in character within the context of this invention, contain atoms other than carbon present in a chain or ring otherwise composed of carbon atoms. Suitable hetero atoms will be apparent to those skilled in the art and include, for example, sulfur, oxygen and nitrogen and form substituents such as, e.g., pyridyl, furanyl, thiophenyl, imidazolyl, etc.

In general, no more than about three radicals or hetero atoms, and preferably no more than one, will be present for each 5 carbon atoms in the hydrocarbon-based substituent. Preferably, there will be no more than three radicals per 10 carbon atoms.

Preferably, the hydrocarbon-based substituents in the compositions of this invention are free from acetylenic unsaturation. Ethylenic unsaturation, when present, preferably will be such that no more than one ethylenic lineage will be present for every 10 carbon-to-carbon bonds in the substituent. The hydrocarbon-based substituents are usually hydrocarbon in nature and more usually, substantially saturated hydrocarbon. As used in this specification and the appended claims, the word "lower" denotes substituents, etc. containing up to seven carbon atoms; for example, lower alkoxy, lower alkyl, lower alkenyl, lower aliphatic aldehyde.

(A) The Borated Nitrogen Containing Dispersant

The borated nitrogen containing dispersant envisioned within this invention has a total base number (TBN) of from 20 to 160 on an oil-free basis. Any oil contained within the dispersant is subtracted out to determine the TBN. The TBN is defined as 56,100 mg KOH times equivalents of titratable nitrogen/grams of sample. Preferably the TBN of the dispersant is from 30 to 100 and most preferably from 30 to 80.

The nitrogen containing dispersants that are borated comprise the Mannich reaction products, succinimide dispersants or olefin-carboxylic acid/carboxylate dispersants.

Mannich Dispersants

Mannich dispersants are the reaction product of a phenol, aldehyde and amine. There are several methods to prepare Mannich dispersants. The first method is to condense the phenol and aldehyde to make an intermediate product which is then condensed with ihe amine to form the Manninch dispersant. The second method is to condense the amine and aldehyde to make an intermediate product which is then condensed with the phenol to form the Mannich dispersant. The third method is to add all three reagents at once (phenol, aldehyde and amine) to form the Mannich dispersant. Within this invention, it is preferred to form the Mannich dispersant by the first method.

The Mannich dispersants are prepared by reacting at least one intermediate (A1) of the formulae (A1)

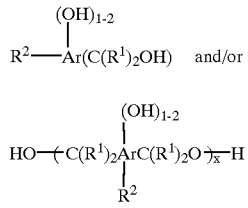

Formula I wherein each $R^1$ is independently hydrogen or lower hydrocarbon-based group; Ar is an aromatic moiety having at least one aliphatic, hydrocarbon-based substituent, $R^2$, of at least 6 carbon atorms; and x is an integer of 1 to about 10 with (A2) at least one amino compound which contains one or more amino groups having hydrogen bonded directly to an amino nitrogen.

The intermediate (A1) is itself prepared by reaction of two reagents.

The first reagent is a hydroxyaromatic compound. This term includes phenols (which are preferred); carbon-, oxygen-, sulfur- and nitrogen-bridged phenols and the like as well as phenols directly linked through covalent bonds (e.g., 4,4'-bis(hydroxy)biphenyl); hydroxy compounds derived from fused-ring hydrocarbons (e.g., naphthols and the like); and dihydroxy compounds such as catechol, resorcinol and hydroquinone. Mixtures of one or more hydroxyaromatic compounds can be used as the first reagent.

The hydroxyaromatic compounds used to make intermediate (A1) of this invention are substituted with at least one, and preferably not more than two, aliphatic or alicyclic substituents, $R^2$, having an average of at least about 30, preferably at least about 50 carbon atoms and up to about 7000 carbon atoms. Typically, such substituents can be derived from the polymerization of olefins such as ethylene, propylene, 1-butene, 2-butene, isobutene and the like. Both homoplymers (made from a single olefin monomer) and interpolymers (made from two or more of olefin monomers) can serve as sources of these substituents and are encompassed in the term "polymers" as used herein and in the appended claims. Substituents derived from polymers of ethylene, propylene, 1-butene and isobutene are preferred, especially those containing an average of at least about 30 and preferably at least about 50 aliphatic carbon atoms. Generally, these substituents contain an average of up to about 700, typically up to about 400 carbon atoms. In some instances, however, higher molecular weight substituents, e.g., those having molecular weights of about 50,000–100,000 are desirable since such substituents can import viscosity index improving properties to the composition. Such higher molecular weights can be calculated from the inherent or intrinsic viscosity using the Mark-Houwink equation and are called viscosity average molecular weights ($\overline{M}v$). Number average molecular weights ($\overline{M}n$) ranging from about 420 to 10,000 are conveniently measured by vapor pressure osmometry (VPO). (This method is used for the $\overline{M}n$ ranges with about 420 to 10,000 set forth herein.)

Introduction of the aliphatic or alicyclic substituent $R^2$ onto the phenol or other hydroxyaromatic compound is usually effected by mixing a hydrocarbon (or a halogenated derivative thereof, or the like) and the phenol at a temperature of about 50°–200° C. in the presence of a suitable catalyst, such as aluminum trichlouide, boron trifluoride, zinc chloride or the like. See, for example, U.S. Pat. No. 3,368,972 which is incorporated by reference for its disclosures in this regard. The substituent can also be introduced by other alkylation processes known in the art.

The phenols used to make intermediate (A1) have the general formula

Formula II

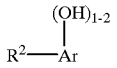

Especially preferred as the first reagent are mono-substituted phenols of the general formula Formula III

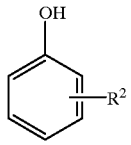

wherein $R^2$ is an aliphatic or alicyclic hydrocarbon-based substituent of $\overline{M}n$ (VPO) of about 420 to about 10,000. Typically, $R^2$ is an alkyl or alkenyl group of about 30 to about 400 carbons.

The second reagent used to make the intermediate (A1) is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, hexamethylene tetraamine, paraldehyde formalin and methal. Formaldehyde and its polymers (e.g., paraformaldehyde, trioxane) are preferred. Mixtures of aldehydes may be used as the second reagent.

In making intermediate (A1) of this invention, the hydroxyaromatic compound is reacted with the aldehyde in the presence of an alkaline reagent, at a temperature up to about 125° C. and preferably about 50°–125° C.

The alkaline reagent is typically a strong inorganic base such as an alkali metal base (e.g., sodium or potassium hydroxide). Other inorganic and organic bases can be used as the alkaline base such as $Na_2CO_3$, $NaHCO_3$, sodium acetate, pyridine, and hydrocarbon-based amines (such as methylamine, aniline, and alkylene polyamines, etc.) may also be used. Mixtures of one or more alkaline bases may be used.

The relative proportions of the various reagents employed in the first step are not critical; it is generally satisfactory to use about 1–4 equivalents of aldehyde and about 0.05–10.0 equivalents of alkaline reagent per equivalent of hydroxyaromatic compound. (As used herein, the term "equivalent" when applied to a hydroxyaromatic compound indicates a weight equal to the molecular weight thereof divided by the number of aromatic hydroxyl groups directly bonded to an aromatic ring per molecule. As applied to the aldehyde or precursors thereof, an "equivalent' is the weight required to produce one mole of monomeric aldehyde. An equivalent of alkaline reagent is that weight of reagent that when dissolved in one liter of solvent will give a normal solution. One equivalent of alkaline reagent will neutralize, i.e., bring to pH 7.0, a 1.0 normal solution of, e.g., hydrochloric or sulfuric acid.)

It is generally convenient to carry out the formation of intermediate (A1) in the presence of a substantially inert, organic liquid diluent, which may be a volatile or nonvolatile. A substantially inert, organic liquid diluent which may or may not dissolve all the reactants, is a material which does not substantially react with the reagents under the reaction conditions. Suitable diluents include hydrocarbons such as naphtha, textile spirits, mineral oil (which is preferred), synthetic oils (as described hereinabove), benzene, toluene and xylene; alcohols such as isopropanol, n-butanol, isobutanol and 2-ethylhexanol; ethers such as ethylene or diethylene glycol mono- or diethyl ether; or the like, as well as mixtures thereof.

The reaction mixture containing the intermediate (A1) formed as just described is usually substantially neutralized. This is an optional step and it is not always employed. Neutralization can be effected with any suitable acidic material, typically a mineral acid or an organic acid or anhydride. Acidic gases such as carbon dioxide, hydrogen sulfide, and sulfur dioxide may also be used. Preferably neutralization is accomplished with carboxylic acids, especially lower hydrocarbon-based carboxylic acid such as formic, acetic or butyric acid. Mixtures of one or more acidic materials can be used to accomplish neutralization. The temperature of neutralization is up to about 150° C., preferably about 50°–150° C. Substantial neutralization means the reaction mixture is brought to a pH ranging between about 4.5 and 8.0. Preferably, the reaction mixture is brought to a minimum pH of about 6 to a maximum of about 7.5.

Intermediate (A1) is usually a mixture of hydroxyalkyl derivatives of the hydroxyaromatic compound and ether condensation products thereof having the general formulae:

(A1)

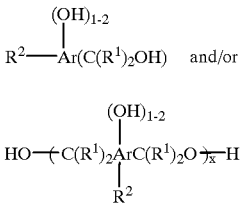

Formula IV wherein $R^1$, $R^2$, Ar and x are as defined hereinabove.

Typically, when the intermediate (A1) is made from mono-substituted phenols, it is a mixture of compounds of the general formulae:

(A1)

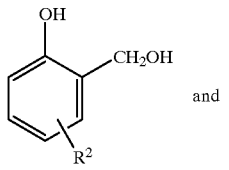

and

Formula V

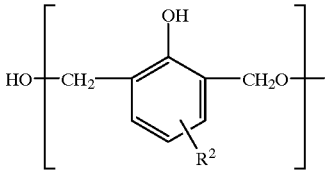

wherein $R^2$ is a substantially saturated aliphatic hydrocarbyl group of about 30 to about 700 carbon atoms.

A particular preferred class of intermediate (A1) are those made from para-substituted phenols and having the general formulae:

(A1)

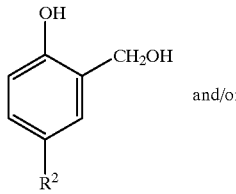

and/or

Formula VI

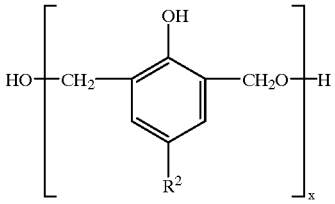

wherein $R^2$ is an alkyl or alkenyl group of about 30 to about 400 carbons and x is an integer of 1 to about 10. Exemplary of $R^2$ in these preferred intermediates are those made from polybutenes. These polybutenes are usually obtained by polymerization of a $C_4$ refinery strea, having a butene content of 35 to 75 weight percent and isobutene content of 30 to 60 weight percent in the presence of a Lewis acid catalyst such as aluminum trichloride or boron trifluoride. They contain predominantly (greater than 80% of total repeat units) isobutylene repeating units of the configuration

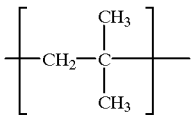

In other preferred intermediates, the $R^2$ is derived from a polypropylene polymer or an ethylene/propylene interpolymer containing an appropriate number of carbon atoms.

The intermediate (A1) is reacted with at least one amino compound (A2) which contains one or more amino groups having hydrogen directly bonded to amino nitrogen. Suitable amino compounds are those containing only primary, only secondary, or both primary and secondary amino groups, as well as polyamines in which all but one of the amino groups may be tertiary. Suitable amino compounds include ammonia, aliphatic amines, aromatic amines, heterocyclic amines and carbocyclic amines, as well as polyamines such as alkylene amines, arylene amines, cyclic polyamines and the hydroxy-substituted derivatives of such polyamines. Mixtures of two or more amino compounds can be used as the amino compound.

Specific amines of these types are methylamine, N-methylethylamine, N-methyl-octylamine, N-cyclohexylaniline, dibutylamine, cyclohexylamine, aniline, di(p-methyl-phenyl)-amine, ortho, meta and para-aminophenol, dodecylamine, octadecylamine, o-phenylenediarnine, N,N'-di-n-butyl-p-phenylenediamine, morpholine, N,N-di-n-butyl-p-phenylene-diamine, piperazine, tetrahydropyrazine, indole, hexahydro-1,3,5-triazine, 1-H-1,2,4-triazole, bis-(p-aminophenyl)-methane, menthanediamine, cyclohexamine, pyrrolidine, 3-amino-5,6-diphenyl-1,2,4-triazine, quinonediimine, 1,3-indanediimine, 2-octadecyl-imidazoline, 2-phenyl-4-methyl-imidazoline, oxazolidine, ethanolamine, diethanolamine, N-3-aminopropyl morpholine, phenothi;azine, 2-heptyl-oxazolidine, 2-heptyl-3-(2-aminopropyl)imidazoline, 4-methyl-imidazoline, 1,3-bis(2-aminoethyl)imidazoline, 2-heptadecyl-4-(2-hydroxyethyl-)imidazoline and pyrimidine.

A preferred group of amino compounds consists of polyamines, especially alkylene polyamines conforming for the most part to the formula Formula VII

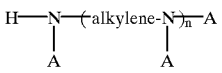

wherein n is an integer of 1 to about 10, A is a hydrocarbon-based substituent or hydrogen atom, preferably a lower alkyl group or a hydrogen atom, and the alkylene radical is preferably a lower alkylene radical of up to 7 carbon atoms. Mixtures of such polyamines are similarly useful. In certain instances, two A groups on the same amino nitrogen can be combined together, sometimes through a nitrogen atom and other times through carbon-to-carbon bonds to form a five or six membered ring including the amino nitrogen, two A groups and, optionally, oxygen or nitrogen.

The alkylene polyamines include principally polymethylene amines, ethylene amines, butylene amines, propylene amines, trimethylene amines, pentylene amines, hexylene amines, heptylene amines, octylene amines, and also the cyclic and the higher homologs of sich amines such as piperazines and aminoalkyl-substituted piperazines. They are exemplified specifically by: ethylene diamine, triethylene tetramine, propylene diamine, decamethylene diamine, octamethylene diamine, di(heptamethylene)triainine, tripropylene tetramine, tetraethylene pentamine, trimethylene diamine, pentaethylene hexamine, di(trimethylene)triamine, 1-(2-aminopropyl)piperazine, 1,4-bis(2-aminoethyl) piperazine, and 2-methyl-1-(2-aminobutyl)piperazine. Higher homologs such as are obtained by condensing two or more of the above-illustrated alkylene amines likewise are useful. Examples of amines wherein two A groups are combined to form a ling include N-aminoethyl morpholine, N-3-aminopropyl-pyrrolidene, and aminoethylpiperazine, etc.

The ethylene polyamines are especially useful. They are described in some detail under the heading "Diamines and Higher Amines" in "Encyclopedia of Chemical Technology", Second Edition, Kirk and Othmer, Volume 7, pages 27–39, Interscience Publishers, New York (1965). Such compounds are prepared most conveniently by the reaction of an alkylene chloride with ammonia. The reaction results in the production of somewhat complex mixtures of alkylene polyamines, including cyclic condensation products such as piperazines. These mixtures find use in the process of this invention. On the other hand, quite satisfactory products may be obtained also by the use of pure alkylene polyamines. An especially useful alkylene polyamine for reasons of economy as well as effectiveness of the products derived therefrom is a mixture of ethylene amines prepared by the reaction of ethylene chloride and ammonia and containing about 3–7 amino groups per molecule.

Hydroxyalkyl-substituted alkylene polyamines, i.e., alkylene polyamines having one or more hydroxyalkyl substituents on the nitrogen atoms, likewise are contemplated for use herein. The hydroxyalkyl-substituted alkylene polyamines are preferably those in which the alkyl group is a lower alkyl group, i.e., an alkyl having less than 8 carbon atoms. Examples of such amines include N-(2-hydroxyethyl)-ethylene diamine, N,N'-bis(2-hydroxyethyl) ethylene diamine, 1-(2-hydroxyethyl)piperazine, mono-2-hydroxy-propyl-substituted diethylene triamine, 1,4-bis(2-hydroxypropyl)piperazine, dihydroxy-propyl-substituted tetraethylene pentamine, N-(3-hydrocypropyl) tetramethylene diamine, etc.

Higher homologs such as are obtained by condensation of the above-illustrated alkylene polyamines or hydroxyalkyl-substituted alkylene polyamines through amino radicals or through hydroxy radicals are likewise useful. It will be appreciated that condensation through amino radicals results in a higher amine accompanied by removal of ammonia and that condensation through the hydroxy radicals results in products containing ether linkages accompanied by removal of water.

Another preferred class of amino compounds are aromatic amines containing about 6 to about 30 carbon atoms and at least one primary or secondary amino group. Preferably, these aromatic amines contain only 1–2 amino groups, 1–2 hydroxy groups, carbon and hydrogen. Examples include aryl amines such as the isomeric amino phenols, aniline, N-lower alkyl anilines, heterocyclic amines such as the isomeric amino pyridines, the isomeric naphthyl amines, phenothiazine, and the $C_{1-30}$ hydrocarbyl substituted analogs such as N-phenyl-alpha-naphthyl amine. Aromatic diamines such as the phenylene and naphthylene diamines can also be used.

Other suitable amino compounds include ureas, thioureas, (including lower alkyl and monohydroxy lower alkyl substituted ureas and thioureas), hydroxylamines, hydrazines, guanidines, amidines, amides, thioamides, cyanamides, amino acids and the like. Specific examples illustrating such compounds are: hydrazine, phenylhydrazine, N,N'-diphenylhydrazine, octadecylhydrazine, benzoylhydrazine, urea, thiourea, N-butylurea, stearylamide, oleylamide, guanidine, 1-phenylguanidine, benzamidine, octadecamidine, N,N'-dimethylstearamidine, cyanamide, dicyandiarmide, guanylurea, aminoguanidine, iminodiacetic acid, iminodipropionitrile, etc.

The intermediate (A1) is reacted with the amino compound (A2), typically at a temperature between about 25° C. and about 225° C. and usually about 55°–180° C. The ratio of reactants in this step is not critical, but about 1–6 equivalents of amino compound (A2) are generally employed per equivalent of intermediate (A1). (The equivalent weight of the amino compound is the molecular weight thereof divided by the number of hydrogens bonded to nitrogen atoms present per molecule and the equivalent weight of time intermediate (A1) is its molecular weight divided by the number of $—C(R^1)_2O—$ units present derived from the aldehyde. The number of equivalents of (A1) is conventionally calculated by dividing the moles of (A1) by the moles of aldehyde used to make it.) It is frequently convenient to react (A1) and (A2) in the presence of a substantially inert liquid solvent/diluent, such as that described hereinabove.

The course of the reaction between the intermediate (A1) and the amino compound (A2) may be determined by measuring the amount of water removed by distillation, azeotropic distillation or the like. When water evolution has ceased, the reaction may be considered complete and any solids present may be removed by conventional means; e.g., filtration, centrifugation, or the like, affording the desired product. It is ordinarily unnecessary to otherwise isolate the product from the reaction mixture or purify it, though, in some instances it may be desirable to concentrate (e.g., by distillation) or dilute the solution/dispersion of the product for ease of handling, etc.

The method of this invention is illustrated by the following examples. All parts are by weight and all molecular weights are determined by V.P.O. unless otherwise indicated.

EXAMPLE A-1

A mixture of 1560 parts (1.5 equivalents) of a polyisobutylphenol having a molecular weight of about 885, 1179 parts of mineral oil and 99 parts of n-butyl alcohol is heated to 80° C. under nitrogen, with stirring, and 12 parts (0.15 equivalent) of 50% aqueous sodium hydroxide solution is added. The mixture is stirred for 10 minutes and 99 parts (3 equivalents) of paraformaldehyde is added. The mixture is stirred at 80°–88° C. for 1.75 hours and then neutralized with 9 parts (0.15 equivalent) of acetic acid.

To the solution of intermediate thus obtained is added at 88° C., with stirring, 172 parts of a commercial polyethylene polyamine mixture containing about 3–7 nitrogen atoms per molecule and about 34.5% by weight nitrogen. The mixture is heated over about 2 hours to 150° C. and stirred at 150°–160° C. for three hours, with volatile material being removed by distillation. The remainder of the volatiles are then stripped at 160° C./30 torr, and the residue filtered at 150° C., using a commercial filter aid material, to yield the desired product as a filtrate in the form of 60% solution in mineral oil containing 1.95% nitrogen.

EXAMPLE A-2

A solution of 4576 parts (4.4 equivalents) of the polyisobutylphenol of Example A-1 in 3226 parts of mineral oil is heated to 55° C. under nitrogen, with stirring, and 18 parts (0.22 equivalent) of 50% aqueous sodium hydroxide solution is added. The mixture is stirred for 10 minutes and then 320 parts (9.68 equivalents) of paraformaldehyde is added. The mixture is heated at 70°–80° C. for 13 hours and then cooled to 60° C. whereupon 20 parts (0.33 equivalent) of acetic acid is added. The mixture is then heated at 110° C. for 6 hours while being blown with nitrogen to remove volatile materials. Nitrogen blowing is continued at 130° C. for an additional 6 hours, after which the solution is filtered at 120° C., using a filter aid material.

To the above solution of intermediate (i.e., alkylphenol/formaldehyde condensate), at 65° C. is added 184 parts of the polyethylene polyamine of Example A-1. The mixture is teated at 110°–135° C. over 4 hours and then blown with nitrogen at 150°–160° C. for 5 hours to remove volatiles. Mineral oil, 104 parts, is added and the mixture filtered at 150° C., using filter aid, to yield the desired product as a 60% solution in mineral oil containing 1.80% nitrogen.

EXAMPLE A-3

To 366 parts (0.2 equivalent) of the intermediate solution described in Example A-2 is added at 60° C., with stirring, 43.4 parts (0.3 equivalent) of N-(3-aminopropyl) morpholine. The mixture is heated at 110°–130° C., with nitrogen blowing, for 5 hours. It is then stripped of volatiles at 170° C./16 torr, and filtered using a filter aid material. The filtrate is the desired product (as a 62.6% solution in mineral oil) containing 1.41% nitrogen.

EXAMPLE A-4

Following the procedure of Example A-3, a reaction product is prepared from 366 parts (0.2 equivalent) of the intermediate solution of Example 2 and 31.5 parts (0.3 equivalent) of diethanolamine. It is obtained as a 62.9% solution in mineral oil, containing 0.70% nitrogen.

EXAMPLE A-5

A mixture of 2600 parts (2.5 equivalents) of the polyisobutylphenol of Example A-2, 750 parts of textile spirits and 20 parts (0.25 equivalent) of 50% aqueous sodium hydroxide is heated to 55° C. under nitrogen, with stirring, and 206 parts (6.25 equivalents) of paraformaldehyde is added. Heating at 50°–55° C., with stirring, is continued for 21 hours after which the solution is blown with nitrogen and heated to 85° C. as volatile materials are removed. Acetic acid, 22 parts (0.37 equivalent), is added over one-half hour at 85°–90° C., followed by 693 parts of mineral oil.

To 315 parts (0.2.31 equivalent) of the solution of alkylphenol/formaldehyde intermediate prepared as described above is added under nitrogen, at 65° C., 26.5 parts of the polyethylene polyamine mixture of Example A-1. The mixture is heated at 65°–90° C. for about 1 hour, and then heated to 120°–130° C. with nitrogen blowing, and finally to 145°–155° C. with continued nitrogen blowing for 3.5 hours. Mineral oil, 57 parts, is added and the solution filtered at 120° C., using a filter aid material. The filtrate is the desired product (69.3% solution in mineral oil) containing 2.11% nitrogen.

EXAMPLE A-6

A solution of 340 parts (0.25 equivalent) of the alkylphenol/formaldehyde intermediate solution of Example A-5 in 128 parts of mineral oil is heated to 45° C. and 30 parts (0.25 equivalent) of tris-(methylol)methyl amine is added, with stirring. The mixture is heated to 90° C. over 0.5 hours, and then blown with nitrogen at 90°–130° C. for 3 hours, with stirring. Finally, it is heated to 150°–160° C. for 5 hours, with nitrogen blowing, cooled to 125° C. and filtered, using a filter aid material. The filtrate is the desired product (as a 60% solution in mineral oil) containing 0.19% nitrogen.

EXAMPLE A-7

To a mixture of 1560 parts (1.5 equivalents) of the polyisobutylphenol of Example A-2 and 12 parts (0.15 equivalent) of 50% aqueous sodium hydroxide solution is added at 68° C., with stirring, 99 parts (3 equivalents) of parafoimaldehyde. The addition period is 15 minutes. The mixture is then heated to 88° C. and 100 parts of a mixture of isobutyl and primary amyl alcohols is added. Heating at 85°–88° C. is continued for 2 hours and then 16 parts of glacial acetic acid is added and the mixture stirred for 15 minutes and vacuum stripped at 150° C. To the residue is added 535 parts of mineral oil, and the oil solution is filtered to yield the desired intermediate.

To 220 parts (0.15 equivalent) of the intermediate solution prepared as described above is added 7.5 parts (0.15 equivalent) of hydrazine hydrate. The mixture is heated to 80–105° C. and stirred at that temperature for 4 hours. Acetic acid, 0.9 part, is then added and stirring is continued at 95°–125° C. for an additional 6 hours. A further 7.5-part-portion of hydrazine hydrate is added and heating and stirring are continued for 8 hours, after which the product is stripped of volatiles under vacuum at 124° C. and 115 parts of mineral oil is added. Upon filtration, the desired product (as a 50% solution in mineral oil) is obtained; it contains 1.19% nitrogen.

EXAMPLE A-8

A mixture of 6240 parts (6 equivalents) of the polyisobutylphenol of Example A-2 and 2814 parts of mineral oil is heated to 60° C. and 40 parts (0.5 equivalent) of 50% aqueous sodium hydroxide solution added, with stirring. The mixture is stirred for 0.5 hour at 60° C., and 435 parts (13.2 equivalents) of 91% aqueous formaldehyde solution is added at 75°–77° C. over 1 hour. Stirring at this temperature is continued for 10 hours, after which the mixture is neutralized with 30 parts of acetic acid and stripped of volatile materials. The residue is filtered using a filter aid material.

A mixture of 629 parts (0.4 equivalent) of the resulting intermediate solution and 34 parts (0.4 equivalent) of dicyandiamide is heated to 210° C. under nitrogen, with stirring, and maintained at 210°–215° C. for 4 hours. It is then filtered through a filter aid material and the filtrate is the desired product (as a 71% solution in mineral oil) containing 1.04% nitrogen.

EXAMPLE A-9

A mixture of 1792 parts (1.6 equivalents) of the polyisobutylphenol of Example A-2 and 1350 parts of xylene is heated to 60° C. and 12.8 parts (0.16 equivalent) of 50% aqueous sodium hydroxide solution added, with stirring. The mixture is stirred at 60°–65° C. for 10 minutes, and then 108 parts (3.28 equivalents) of paraformaldehyde is added. Heating is continued at 65°–75° C. for 5 hours, after which 14.3 parts (0.24 equivalent) of acetic acid is added. The acidified mixture is heated at 75°–125° C. for ½ hour and then stripped under vacuum. The resulting solution of intermediate is filtered through a filter aid material.

To 2734 parts (1.4 equivalents) of the above-described intermediate solution, maintained at 65° C., is added 160.7 parts of the polyethylene polyamine of Example A-1. The mixture is heated for 1½ hours at 65°–110° C. and for 1½ hours at 110–140° C., after which heating at 140° C. is continued with nitrogen blowing for 11 hours, while a xylene-water azeotrope is collected by distillation. The residual liquid is filtered at 100° C., using a filter aid material, and the filtrate is the desired product as a 60% solution in xylene containing 1.79% nitrogen.

Succinimide Dispersants

Succinimide dispersants have a starting material which is a hydrocarbyl substituted succinic acylating agent. Three different succinimide dispersants are envisioned in this invention. The succinimide dispersants are the reaction product of a hydrocarbyl substituted succinic acylating agent and an amine. The succinimide dispersants formed depend upon the type of the hydrocarbyl substituted succinic acylating employed. Three types of hydrocarbyl substituted succinic acylating agents are envisioned as Type I, Type II and Type III. The Type I succinic acylating agent is of the formula

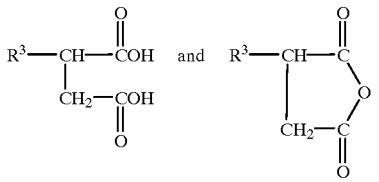

In the above formula, $R^3$ is a hydrocarbyl based substituent having from 40 to 500 carbon atoms and preferably from 50 to 300 carbon atoms. The Type I hydrocarbyl-substituted succinic acylating agents are prepared by reacting one mole of an olefin polymer or chlorinated analog thereof with one mole of an unsaturated carboxylic acid or derivative thereof such as fumaric acid, maleic acid or maleic anhydride. Typically, the succinic acylating agents are derived from maleic acid, its isomers, anhydride and chloro and bromo derivatives.

The Type II hydrocarbyl substituted succinic acylating agent, hereinafter Type II succinic acylating agent, is characterized as a polysuccinated hydrocarbyl substituted succinic acylating agent such that more than one mole of an unsaturated carboxylic acid or derivative is reacted with one mole of an olefin polymer or chlorinated analog thereof.

The Type III hydrocarbyl substituted succinic acylating agent, hereinafter Type III succinic acylating agent, is characterized as a monosuccinated or disuccinated hydrocarbyl substituted acylating agent wherein the hydrocarbyl group is an ethylene/alpha-olefin based polymer.

The olefin monomers from which the olefin polymers are derived that ultimately become $R^3$ are essentially the same as the substituent $R^2$ in the preparation of the Mannich dispersants. The salient difference is that $R^2$ is from 30 to 7000 carbon atoms and $R^3$ is from 40 to 500 carbon atoms and preferably from 50 to about 300 carbonations. That being the case, it is not necessary to repeat the disclosure.

As noted above, the hydrocarbon-based substituent $R^3$ present in the Type I succinic acylating agent is derived from olefin polymers or chlorinated analogs thereof. The olefin monomers from which the olefin polymers are derived are polymerizable olefins and monomers characterized by having one or more ethylenic unsaturated group. They can be monoolefinic monomers such as ethylene, propylene, butene-1, isobutene and octene-1, or polyolefinic monomers (usually diolefinic monomers such as butadiene-1,3 and isoprene). Usually these monomers are terminal olefins, that is, olefins characterized by the presence of the group $$>C{=}CH_2$$

However, certain internal olefins can also serve as monomers (these are sometimes referred to as medial olefins). When such olefin monomers are used, they normally are employed in combination with terminal olefins to produce olefin polymers which are irterpolymers. Although the hydrocarbyl-based substituents may also include aromatic groups (especially phenyl groups and lower alkyl and/or lower alkoxy-substituted phenyl groups such as para(tertiary butyl)phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally, the olefin polymers are homo- or interpolymers of terminal hydrocarbyl olefins of about 2 to about 16 carbon atoms. A more typical class of olefin polymers is selected from that group consisting of homo- and interpolymers of terminal olefins of two to six carbon atoms, especially those of two to four carbon atoms.

Specific examples of terminal and medial olefin monomers which can be used to prepare the olefin polymers from which the hydrocarbon based substituents in the acylating agents used in this invention are ethylene, propylene, butene-1, butene-2, isobutene, pentene-1, hexene-1, heptene-1, octene-l, nonene-1, decene-1, pentene-2, propylene tetramer, diisobutylene, isobutylene trimer, butadiene-1,2 butadiene-1,3 pentadiene-1,2 pentadiene-1,3, isoprene, hexadiene-1,5, 2-chlorobutadiene-1,3, 2-methylheptene-1, 3-cyclohexylbutene-1, 3,3-dimethylpentene-1, styrenedivinylbenzene, vinylacetate, allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutene)s. These polyisobutenyl polymers may be obtained by polymerization of a $C_4$ refinery stream having a butene content of about 35 to about 75 percent by weight and an isobutene content of about 30 to about 60 percent by weight in the presence of a Lewis acid catalyst such as aluminum chloride or boron trifluoride. These poly(isobutene)s contain predominantly (that is, greater than 80% of the total repeat units) isobutene repeat units of the configuration

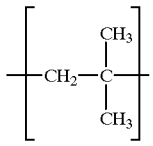

The Type II hydrocarbyl-substituted succinic acylating agent is represented by $R^4$ and is a hydrocarbyl, alkyl or alkenyl group of about 40, often about 50, to about 500, sometimes about 300, carbon atoms. U.S. Pat. No. 4,234,435 is expressly incorporated herein by reference for its disclosure of procedures for the preparation of polysuccinated hydrocarbyl-substituted succinic acylating agents and dispersants prepared therefrom.

Such Type II succinic acid acylating agents can be made by the reaction of maleic anhydride, maleic acid, or fumaric acid with the afore-described olefin polymer, as is shown in the patents referred to above. Generally, the reaction involves merely heating the two reactants at a temperature of about 150° C. to about 200° C. Mixtures of these polymeric olefins, as well as mixtures of these unsaturated mono- and polycarboxylic acids can also be used.

In another embodiment, the Type II succinic acylating agent consists of substituent groups and succinic groups wherein the substituent groups are derived from polyalkenes characterized by an Mn value of at least about 1200 and an Mw/Mn ratio of at least about 1.5, and wherein said acylating agents are characterized by the presence within their structure of an average of at least about 1.3 succinic groups for (each equivalent weight of substituent groups.

This Type II succinic acylating agent can be characterized by the presence within its structure of two groups or moieties. The first group or moiety is referred to hereinafter, for convenience, as the "substituent group(s)" $R^4$ and is derived from a polyalkene. The polyalkene from which the substituted groups are derived is characterized by an Mn (number average molecular weight) value of at least 1200 and more generally from about 1500 to about 5000, and an Mw/Mn value of at least about 1.5 and more generally from about 1.5 to about 6. The abbreviation Mw represents the weight average molecular weight. The number average molecular weight and the weight amperage molecular weight of the polybutenes can be measured by well-known techniques of vapor phase osmometry (VPO), membrane osomometry and gel permeation chromatography (GPC). These techniques are well-known to those skilled in the art and need not be described herein.

The second group or moiety is referred to herein as the "succinic group(s)". The succinic groups are those groups characterized by the stricture (VIII)

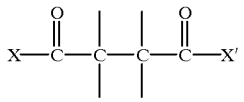

wherein X and X' are the same or different provided at least one of X and X' is such that the second substituted succinic acylating agent can function as carboxylic acylating agents. That is, at least one of X and X' must be such that the substituted acylating agent can form amides or amine salts with, and otherwise function as a conventional carboxylic acid acylating agents. Transesterification and transamidation reactions are considered, for purposed of this invention, as conventional acylating reactions.

Thus, X and/or X' is usually —OH, —0-hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C—(O)X and —C(O)X' can enter into acylation reactions.

One of the unsatisfied valences in the grouping

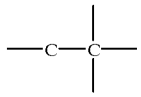

of Formula VIII forns a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The Type II succinic acylating agents are characterized by the presence within their structure of 1.3 succinic groups (that is, groups corresponding to Formula VIII) for each equivalent weight of substituent groups $R^4$. For purposes of this invention, the number of equivalent weight of substituent groups $R^4$ is deemed to be the number corresponding to the quotient obtained by dividing the Mn value of the polyalkene from which the substituent is derived into the total weight of the substituent groups present in the substituted succinic acylating agents. Thus, if the Type II succinic acylating agent is characterized by a total weight of substituent group of 40,000 and the Mn value for the polyalkene from which the substituent groups are derived is 2000, then that second substituted succinic acylating agent is characterized by a total of 20 (40,000/2000=20) equivalent weights of substituent groups. Therefore, that particular second succinic acylating agent must also be characterized by the presence within its structure of at least 26 succinic groups to meet one of the requirements of the novel succinic acylating agents of this invention.

Another requirement for the Type II succinic acylating agents is that the substitutuent group $R^4$ must have been derived from a polyalkene characterized by an Mw/Mn value of at least about 1.5.

Polyalkenes having the Mn and Mw values discussed above are known in the art and can be prepared according to conventional procedures. Several such polyalkenes, especially polybutenes, are commercially available.

In one preferreed embodiment, the succinic groups will normally correspond to the formula (IX)

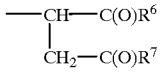

wherein $R^6$ and $R^7$ are each independently selected from the group consisting of —OH, —Cl, —O-lower ilkyl, and when taken together, R and R' are —O—. In the latter case, the succinic group is a succinic anhydride group. All the succinic groups in a particular Type II succinic acylating agent need not be the same, but they can be the same. Preferably, the succinic groups will correspond to (X)

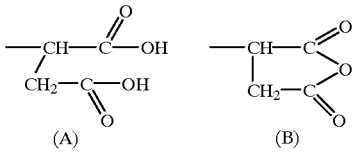

(A) (B)

and mixtures of (X(A)) and (X(B)). Providing Type II succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.3. The maximum number generally will not exceed 6. Preferably the minimum will be 1.4; usually 1.4 to about 6 succinic groups for each equivalent weight of substituent group. A range based on this minimum is at least 1.5 to about 3.5, and more generally about 1.5 to about 2.5 succinic groups per equivalent weight of substituent groups.

From the foregoing, it is clear that the Type II succinic acylating agents can be represented by the symbol $R^4(R^5)_y$ wherein $R^4$ represents one equivalent weight of substituent group, $R^5$ represents one succinic group corresponding to Formula (VIII), Formula (IX), or Formula (X), as discussed above, and y is a number equal to or greater than 1.3. The more preferred embodiments of the invention could be similarly represented by, for example, letting $R^4$ and $R^5$ represent more preferred substituent groups and succinic groups, respectively, as discussed elsewhere herein and by letting the value of y vary as discussed above.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of Mn for example, a minimum of about 800 and a maximum of about 5000 are preferred with an Mn value in the range of from about 1300 or 1500 to about 5000 also being preferred. A more preferred Mn value is one in the range of from about 1500 to about 2800. A most preferred range of Mn values is from about 1500 to about 2400. With polybutenes, an especially preferred minimum value for Mn is about 1700 and an especially preferred range of Mn values is from about 1700 to about 2400.

As to the values of the ratio Mw/Mn, there are also several preferred values. A minimum Mw/Mn value of about 1.8 is preferred with a range of values of about 1.8 up to about 5.0 also being preferred. A still more preferred minimum value of Mw/Mn is about 2.0 to about 4.5 also being a preferred range. An especially preferred minimum value of Mw/Mn is about 2.5 with a range of values of about 2.5 to about 4.0 also being especially preferred.

Before proceeding to a further discussion of the polyalkenes from which the substituent groups are derived, it should be pointed out that these preferred characteristics of the second succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of Mn or Mw/Mn. They are intended to be dependent in the sense that, for example, when a preference for ae minimum of 1.4 to 1.5 succinic groups is combined with more preferred values of Mn and/or Mw/Mn, the combination of preferences does, in fact, describe still further more preferred embodiments of this component. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups are derived are homopolymers and interpolymers of polymerizable olefin monomers as disclosed within $R^2$ above.

In preparing the Type II succinic acylating agent, one or more of the above-described polyalkenes is reacted with one or more acidic reactants selected from the group consisting of maleic or fumaric reactants of the general formula $$X(O)C—CH=CH—C(O)X' \quad (XI)$$

wherein X and X' are as defined hereinbefore. Preferably the maleic and fumaric reactants will be one or more compounds corresponding to the formula $$R^6C(O)—CH=CH—C(O)R^7 \quad (XII)$$

wherein $R^6$ and $R^7$ are as previously defined herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the second substituted succinic acylating agent. The especially preferred reactants are maleic acid, maleic anhydride, and mixture of these. Due to availability and ease of reaction, maleic anhydride will usually be employed.

The Type III succinic acylating is prepared by reacting one mole of an ethylene alpha-olefin copolymer or chlorinated analog thereof with one mole of an unsaturated carboxylic acid or derivative thereof such as fumaric acid, maleic acid or maleic anhydride. U.S. Pat. No. 5,382,698 is expressly incorporated herein by reference for its disclosure of procedures for the preparation of ethylene alpha-olefin copolymers.

The one or more polyalkenes and one or more maleic or fumaric reactants can be reacted according to any of several known procedures in order to produce the Type I, Type II or Type III acylating agents of the present invention.

In preparing the succinimide dispersant or ester dispersant, the hydrocarbyl substituted succinic acylating agent is reacted with (a) ammonia or (b) an amine.

The substituted succinic anhydride ordinarily is reacted directly with an ethylene amine although in some circumstances it may be desirable first to convert the anhydride to the acid before reaction with diamine. In other circumstances, it may be desirable to prepare the substituted succinic acid by some other means and to use an acid prepared by such other means in the process. In any event, either the acid or the anhydride may be used in the process of this invention.

The term "ethylene amine" is used in a generic sense to denote a class of polyamines conforming for the most part of the structure $$H_2N(CH_2\underset{\underset{R^{16}}{|}}{C}HNH)_xH$$

in which x is an integer and $R^{16}$ is independently a low molecular weight alkyl radical or hydrogen. Thus it includes, for example, ethylene diamine, diethylene triamine, triethylene tetramine, tetraethylene pentamine, pentaethylene hexamine, etc. These compounds are discussed in some detail under the heading "Ethylene Amines" in "Encyclopedia of Chemical Technology," Kirk and Otlumer, vol. 5, pages 898–905, Interscience Publishers, New York (1950) and also within the Mannich dispersants as (A2). Such compounds are prepared most conveniently by the reaction of ethylene dichloride with ammonia. This procedure results in the production of somewhat complex mixtures of ethylene amines, including cyclic condensation products such as piperazines and these mixtures find use in the process of this invention. On the other hand, quite satisfactory products may be obtained also by the use of pure ethylene amines. An especially useful ethylene amine, for reasons of economy as well as effectiveness as a dispersant, is a mixture of ethylene amines prepared by the reaction ethylene chloride and ammonia, having a composition which corresponds to that of tetraethylene pentamine. This is available in the trade under the trade name "Polyamine H."

It has been noted that at least one half of a chemical equivalent amount of the ethylene amine per equivalent of substituted succinic anhydride must be used in the process to produce a satisfactory product with respect to dispersant properties and generally it is preferred to use these reactants in equivalent amounts. Amounts up to 2.0 chemical equivalents (per equivalent of substituted succinic anhydride) have been used with success, although there appears to be no advantage attendant upon the use of more than this amount. The chemical "equivalency" of the ethylene amine reactant is upon the nitrogen content, i.e., one having four nitrogens per molecule has four equivalents per mole.

In the reactions that follow, the amine is $RNH_2$ and it is understood that the $RNH_2$ is an ethylene amine.

The reaction of the process involves a splitting out of water and the reaction conditions are such that this water is removed as it is formed. Presumably, the first principal reaction that occurs, is the formation of a half amide

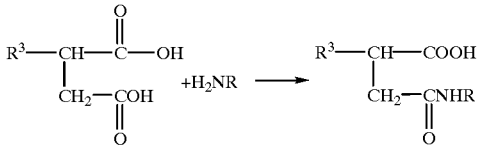

followed then by reaction of the acid and amide functionalities to form the succinimide.

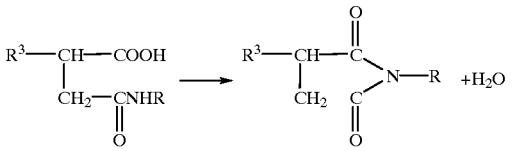

The first reaction appears to take place spontaneously (when a substituted succinic anhydride is used) upon mixing, but the second requires heating. Temperatures within the range of about 80° C. to about 200° C. are satisfactory, and within this range it is preferred to use a reaction temperature of from about 100° C. to about 160° C. A useful method of carrying out this step is to add some toluene to the reaction mixture and to remove the water by azeotropic distillation. As indicated before there is also some salt-formation.

Specific examples of the process by which the succinic dispersants may be prepared utilizing the Tyipe I succinic acylating agent are as follows.

EXAMPLE A-10

A polyisobutenyl succinic anhydride was prepared by the reaction of a chlorinated polyisobutylene with maleic anhydride at 200° C. The polyisobutenyl radical had an average molecular weight of 850 and the resulting alkenyl succinic anhydride was found to have an acid number of 113 (corresponding to an equivalent weight of 500). To a mixture of 500 grams (1 equivalent) of this polyisobutenyl succinic anhydride and 160 grams of toluene there was added at room temperature 35 grams (1 equivalent) of diethylene triamine. The addition was made portion-wise throughout a period of 15 minutes, and an initial exothermic reaction caused the temperature to rise to 50° C. The mixture then was heated and a water-toluene azeotrope distilled from the mixture. When no more water would distill, the mixture was heated to 150° C. at reduced pressure to remove the toluene. The residue was diluted with 350 grams of mineral oil and this solution was found to have a nitrogen content of 1.6%.

EXAMPLE A-11

The procedures of Example A-10 was repeated using 31 grams (1 equivalent) of ethylene diamine as the amine reactant. The nitrogen content of the resulting product was 1.4%.

EXAMPLE A-12

The procedure of Example A-10 was repeated using 55.5 grams (1.5 equivalents) of an ethylene amine mixture having a composition corresponding to that of triethylene tetramine. The resulting product had a nitrogen content of 1.9%.

EXAMPLE A-13

The procedure of Example A-10 was repeated using 55.0 grams (1.5 equivalents) of triethylene tetramine as the amine reactant. The resulting product had a nitrogen content of 2.2%.

EXAMPLE A-14

To a mixture of 140 grams of toluene and 400 grams (0.78 equivalent) of a polyisobutenyl succinic ahhydride (having an acid number of 109 and prepared from maleic anhydride and the chlorinated polyisobutylene of Example A-10) there was added at room temperature 63.6 grams (1.55 equivalents) of an ethylene amine mixture having an average composition corresponding to that of tetraethylene pentamine and available from Union Carbide under the trade name "Polyamine H." The mixture was heated to distill the water-toluene azeotrope and then to 150° C. at reduced pressure to remove the remaining toluene. The residual polyamide had a nitrogen content of 4.7%.

EXAMPLE A-15

The procedure of Example A-10 was repeated using 46 grams (1.5 equivalents) of ethylene diiamine as the amine reactant. The product which resulted had a nitrogen content of 1.5%.

EXAMPLE A-16

A polyisobutenyl succinic anhydride having an acid number of 105 and an equivalent weight of 540 was prepared by the reaction of a chlorinated polyisobutylene (having an average molecular weight of 1,050 and a chlorine content of 4.3%) and maleic anhydride. To a mixture of 300 parts by weight of the polyisobutenyl succinic anhydride and 160 parts of weight of mineral oil there was added at 65–95° C. an equivalent amount (25 parts of weight) of Polyamine H (identified in Example A-14). This mixture then was heated to 150° C. to distill all of the water formed in the reaction. Nitrogen was bubbled through the mixture at this temperature to insure removal of the last traces of water. The residue was diluted by 79 parts by weight of mineral oil and this oil solution found to have a nitrogen content of 1.60%.

EXAMPLE A-17

A mixture of 2,112 grams (3.9 equivalent) of the polyisobutenyl succinic anhydride of Example A-16, 136 grams (3.9 equivalents) of diethylene triamine, and 1,060 grams of mineral oil was heated at 140–150° C. for one hour. Nitrogen was bubbled through the mixture at this temperature for four more hours to aid in the removal of water. The residue was diluted with 420 grams of mineral oil and this oil solution was found to have a nitrogen content of 1.3%.

EXAMPLE A-18

To a solution of 1,000 grams (1.87 equivalents) of the polyisobutenyl succinic anhydride of Example A-16, in 500 grams of mineral oil there was added at 85–95° C. 70 grams (1.87 equivalents) of tetraethylene pentamine. The mixture then was heated at 150–165° C. for four hours, blowing with nitrogen to aid in the removal of water. The residue was diluted with 200 grams of mineral oil and the oil solution found to have a nitrogen content of 1.4%.

Specific examples for the preparation of succinic dispersants utilizing the Type II succinic acylating agent are as follows.

EXAMPLE A-19

A mixture of 510 parts (0.28 mole) of polyisobutene ( $\overline{M}n$=1845; $\overline{M}w$=5325) and 59 parts (0.59 mole) of maleic anhydride is heated to 110° C. This mixture is heated to 190° C. in seven hours during which 43 parts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired polyisobutene-substituted Type II succinic acylating agent having a saponification equivalent number of 87 as determined by ASTM procedure D-94.

A mixture is prepared by the addition of 10.2 parts (0.25 equivalent) of a commercial mixture of ethylene polyamines having about 3 to about 10 nitrogen atoms per molecule to 113 parts of mineral oil and 161 parts (0.25 equivalent) of the substituted succinic acylating agent prepared above at 138° C. The reaction mixture is heated to 150° C. in 2 hours and stripped by blowing with nitrogen. The reaction mixture is filtered to yield the filtrate as an oil solution of the desired product.

EXAMPLE A-20

A mixture of 1000 parts (0.495 mole) of polyisobutene ( $\overline{M}n$=2020; $\overline{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C. an additional 59 parts (0.83 mole) of chlorine is added over 4 hours. The reaction mixture is stripped by heating at 186°–190° C. with nitrogen blowing for 26 hours. The residue is the desired polyisobutene-substituted Type II succinic acylating agent having a saponification equivalent number of 87 as determined by ASTM procedure D-94.

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the above-prepared succinic acylating agent at 140°–145° C. The reaction mixture is heated to 155° C. in 3 hours and stripped by blowing with nitrogen. The reaction mixture is filtered to yield the filtrate as an oil solution of the desired product.

EXAMPLE A-21

Added to a reactor is 1000 parts (0.5 mole) of a polyisobutene ($\overline{M}n$=2000, $\overline{M}w$=7000). The contents are heated to 135° C. and 106 parts (1.08 moles) of maleic anhydride is added. The temperature is increased to 165° C. and gaseous chlorine, 90 parts (1.27 moles) is added over a six hour period. During the chlorine addition, the temperature increases to 190° C.

To 1000 parts of the above product is added 1050 parts diluent oil and the contents are heated to 110° C. at which time 69.4 parts (1.83 equivalents) of polyamines is added. The temperature increases to 132° C. during the polyamine addition. The temperature is increased to 150° C. while blowing with nitrogen. Oil, 145 parts, is added and the contents are filtered to give a product containing 53% oil, 1.1% nitrogen and 21 total base number.

The term "condensed polyamine" or its cognate "polyamine condensates" are polyamines prepared by the reaction of a polyhydric alcohol having three hydroxy groups or an amino alcohol having two or more hydroxy groups that is reacted with an alkylene polyamine having at least two primary nitrogen atoms and wherein the alkylene group contains 2 to about 10 carbon atoms; and wherein the reaction is conducted in the presence of an acid catalyst at an elevated temperature.

Methods for preparing this condensed polyamine are well-known in the art and need not be illustrated in further detail here. For example, see U.S. Pat. No. 5,368,615, which is hereby incorporated by reference for its disclosure to the preparation of this condensed polyamine.

The succinic acid acylating agent can also react with hydroxyamines (amino alcohols).

Amino alcohols contemplated as suitable for use have one or more amine groups and one or more hydroxy groups. Examples of suitable amino alcohols are the N-(hydroxy-lower alkyl)amines and polyamines such as 2-hydroxyethylamine, 3-hydroxybutylaamine, di-(2-hydroxyethyl)amine, tri(2-hydroxyethyl)amine, di-(2-hydroxypropyl)amine, N,N,N'-tri(2-hydroxyethyl) ethylenediamine, N,N,N'N'-tetra-(2-hydroxyethyl) ethylenediamine, N-(2-hydroxyethyl)-piperazine, N,N'-di-(3-hydroxypropyl)piperazirie, N-(2-hydroxyethyl) morpholine, N-(2-hydroxyethyl)-2-morpholinone, N-(2-hydroxyetlhyl)-3-methyl-2-morpholinone, N-(2-hydroxypropyl-6-methyl-2-morpholinorne, N-(2-hydroxyethyl-5-carbethoxy-2-piperidone, N-(2-hydroxypropyl)-5-carbethoxy-2-piperidone, N-(2-hydroxyethyl)-5-(N-butylcarbamyl-2-piperidone, N-(2-hydroxyethyl-piperidine, N-(4-hydroxybutyl)-piperidine, N,N-di-(2-hydroxyethyl)glycine, and ethers thereof with aliphatic alcohols, especially lower alkanols, N,N-di(3-hydroxypropyl)glycine, and the like. Also contemplated are other mono-and poly-N-hydroxyalkyl-substituted alkylene polyamines wherein the alklylene polyamine are as described above; especially those that contain two to three carbon atoms in the alkylene radicals and the alkylene polyamine contains up to seven amino groups such as the reaction product of about two moles of propylene oxide and one mole of diethylenetriamine.

Further amino alcohols are the hydroxy-substituted primary amines described in U.S. Pat. No. 3,576,743 by the general formula $$R_a—NH_2$$

where $R_a$ is a monovalent organic radical containing at least one alcoholic hydroxyl group, according to this patent, the total number of carbon atoms in $R_a$ will not exceed about 20. Hydrcxy-substituted aliphatic primary amines containing a total of up to about 10 carbon atoms are particularly useful. Especially preferred are the polyhydroxy-substituted alkanol primary amines wherein there is only one amino group present (i.e., a primary amino group) having one alkyl substituent containing up to 10 carbon atoms and up to 6 hydroxyl groups. These alkanol primary amines correspond to $$R_a—NH_2$$

where $R_a$ is a mono- or polyhydroxy-substituted alkyl group. It is desirable that at least one of the hydroxyl groups be a primary alcoholic hydroxyl group. Trismethylolaminomethane is the single most preferred hydroxy-substituted primary amine. Specific examples of the hydroxy-substituted primary amines include 2-amino-1-butanol, 2-aminio-2-methyl-1-propanol, p-(beta-hydroxyethyl)-analine, 2-amino-1-propanol, 3-amino-1-propanol, 2-amino-2-methyl-1,3-propanediol, 2-amino-2-ethyl-1,3-propanediol, N-(beta-hydroxypropyl)-N'-betaaminoethyl)-piperazine, tris(-hydoxymeizhyl)amino methane (also known as trismethylolamino methane), 2-amino-1-butynol, ethanolamine, beta-(beta-hydroxy ethoxy)-ethyl amine, glucamine, glucosamine, 4-amino-3-hydroxy-3-methyl-1-butene (which can be prepared according to procedures known in the art by reacting isopreneoxide with ammonia), N-(3-aminopropyl)-4-(2-hydroxyethyl)-piperadine, 2-amino-6-methyl-6-hepanol, 5-amino-1-pentanol, N-(beta-hydroxyethyl)-1,3-diamino propane, 1,3-diamino-2-hydroxy-propane, N-(beta-hydroxy ethoxyethyl) ethylenediamine, and the like. For further description of the hydroxy-substituted primary amines contemplated as being useful as (a), and/or (b), U.S. Pat. No. 3,576,743 is expressly incorporated herein by reference for its disclosure of such amines.

In examples A-10 to A-18 the polyisobutyl succinic anhydride is prepared by reacting polyisobutene having a molecular weight of 1000 with chlorine to generate a chlorinated polyisobutene. The chlorinated polyisobutene is reacted with maleic anhydride to form the hydrocarbon-substituted succinic anhydride and by-product hydrogen chloride. The concern with this procedure is that there is residual chloride in the hydrocarbon-substituted succinic anhydride and when further reacted with alcohols or amines gives a final product that also contains residual chlorine. This residual chlorine may cause deleterious effects in certain formulations or in certain applications.

Additionally, due to environmental concerns, it has now become desirable to eliminate or reduce the level of chlorine. One potential solution to eliminating the chlorine contained in lubricant and fuel additives is simply not to use chlorine in the manufacturing process. Another potential solution is to develop procedures for treating such compositions to remove the chlorine which is present. One procedure for treating various chlorine-containing organic compounds to reduce the level of chlorine therein is described in a European patent application published under Publication No. 655,242. The procedure described therein for reducing the chlorine content of organochlorine compounds comprises introducing a source of iodine into the organochlorine compound and contacting the components of the resulting mixture for a sufficient; amount of time to reduce the chlorine content without substantially incorporating iodine or bromine into the organochlorine compound. This procedure is successful in reducing the chlorine content of organochlorine compounds, but, in some instances, it is desirable to further reduce the amount of chlorine in additive compositions which are to be utilized in lubricants and fuels.

One technique for reducing the amount of chlorine in additive compositions based on polyalkenyl-substituted dicarboxylic acids is to prepare such hydrocarbon-substituted dicarboxylic acids in the absence of chlorine, and procedures have been described for preparing such compounds by the "Thermal" process in which the polyolefin and the unsaturated dicarboxylic acid are heated together, optimally in the presence of a catalyst. However, when this procedure is used, it is more difficult to incorporate an excess of the succinic groups into the polyalkenyl-substiurted succinic acylating agents, and dispersants prepared from such acylating agents do not exhibit sufficient viscosity index improving characteristics.

EXAMPLE A-22

A polyisobutenyl (molecular weight of 1000) succinic anhydride is prepared according to Example A-16. After obtaining the anhydride, 1000 parts of it is treated with 4 parts of iodine which lowers the chlorine content to 0.1 percent. This low chlorinated anhydrice is diluted with 667 parts of diluent oil and 1000 parts of the oil diluted anhydride is reacted with 103 parts of a commercial mixture of polyamines. A low chlorinated succinimide dispersant is obtained having a 40% oil content, 45 total base number and 2.0% nitrogen.

EXAMPLE A-23

The polyisobutenyl (molecular weight of 1000) succinic anhydride of Example A-16 (1000 parts) and 806 parts oil and a mixture of 698 parts oil with 112 parts of a commercial mixture of polyamines is combined together. The contents are heated to 110–121° C. to effect neutralization. The contents are then heated to 150° C. and held for 1 hour at this temperature. The contents are filtered to give a product having 40% oil, 45 total base number and 2.0% nitrogen.

EXAMPLE A-24

Following essentially the same procedure of Example A-19, 1000 grams of the polyisobutene is reacted with a total of 106 grams maleic anhydride and a total of 90 grams chlorine. After obtaining the anhydride, 1000 parts of it is treated with 4 parts of iodine which lowers the chlorine content to 0.1 percent. To 1000 grams of this low chlorinated anhydride is added 207 grams of diluent oil. The contents are heated to 110° C. and 39 grams of a commercial mixture of polyamines is added over a two-hour period while allowing the contents to exotherm to 127° C. The contents are heated to 152° C. and held for one hour with nitrogen blowing to remove water of reaction. Additional oil is added, 23 grams, and the contents are filtered to give a product containing 50% oil, 1.05% nitrogen, 250 ppm halogen and 18 total base number.

Olefin—Carboxylic Acid/Carboxylate Dispersant

This dispersant is prepared by a process comprising reacting, usually in the presence of an acidic catalyst, more than 1.5 moles, preferably from about 1.6 to about 3 moles of at least one carboxylic reactant per equivalent of at least one olefinic compound wherein and are defined in greater detail hereinbelow.

All of the reactants may be present at the same time. It has been found that improvements in yield and purity of product are sometimes attained when the carboxylic reactant is added portionwise over an extended period of time, usually up to about 10 hours, more often from 1 hour up to about 6 hours, frequently from about 2–4 hours. However, it is generally preferred to have all of the reactants present at the outset. Water is removed during reaction.

Optionally the process for this dispersant may be conducted in the presence of a solvent. Well-known solvents include aromatic and aliphatic solvents, oil, etc. When a solvent is used, the mode of combining reactants does not appear to have any effect.

The process of this dispersant is optionally conducted in the presence of an acidic catalyst. Acid catalysts, such as organic sulfonic acids, for example, paratoluene sulfonic acid and methane sulfonic acid, heteropolyacids, the complex acids of heavy metals (e.g., Mo, W, Sn, V, Zr, etc.) with phosphoric acids (e.g., phosphomolybdic acid), and mineral acids, for example, H2SO4 and phosphoric acid, are useful. The amount of catalyst used is generally small, ranging from about 0.01 mole % to about 10 mole %, more often from about 0.1 mole % to about 2 mole %, based on moles of olefinic reactant.

Methods for preparing this type of dispersant are well known in the art and need not be illustrated in further detail here. For example, see U.S. Pat. No. 5,739,356, which is hereby incorporated by reference for its disclosure of the preparation of this dispersant.

The borated dispersants contain from 0.1% up to about 5%, preferably from 0.5% up to about 4%, and most preferably from 0.7% up to about 3% by weight boron. The borated dispersants are prepared by reacting one or more previously described dispersants with one or more boron compounds. The boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Preferably, the boron compound is boric acid.

The following, examples relate to the preparation of borated dispersants.

EXAMPLE A-25

A mixture of 372 grams (6 atomic proportions of boron) of boric acid and 14,960 grams (12 equivalents on a base number basis) of an acylated nitrogen-containing dispersant of Example A-22 are heated at 150° C. for 3 hours and then filtered. The filtrate is found to have a boron content of 0.44%, a nitrogen content of 2.09% and contains 39.8% oil.

EXAMPLE A-26

A mixture of 372 grams (6 atomic proportions of boron) of boric acid and 33,660 grams (12 equivalents on a base number basis) of an acylated nitrogen-containing dispersant of Example A-24 are heated to 150° C. for 3 hours and then filtered. The filtrate is found to have a boron content of 0.16%, a nitrogen content of 0.98% and contains 47.8% oil.

(B) The Metal Salt of a Phosphorus Acid

The metal salts of the phosphorus acid are characterized by the formula (XIII)

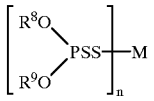

wherein $R^8$ and $R^9$ are each independently hydrocarbyl groups containing from 3 to about 13 carbon atoms, M is a metal, and n is an integer equal to the valence of M.

The hydrocarbyl groups $R^8$ and $R^9$ in the dithiophosphate may be alkyl, cycloalkyl, aralkyl or alkaryl groups, or a substantially hydrocarbon group of similar structure. By "substantially hydrocarbon" is meant hydrocarbons which contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkylcyclohexyl radicals. Many substituted hydrocarbon groups may also be used, e.g., chlorophentyl, dichlorophenyl, and dichlorodecyl.

In another embodiment, at least one of $R^8$ and $R^9$ in Formula XIII is an isopropyl or secondary butyl group. In yet another embodiment, both $R^8$ and $R^9$ are secondary alkyl groups.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C. Thus, the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, nickel or mixtures thereof. The Group II metals, aluminum, tin, iron, cobalt, lead, molybdenum, manganese, nickel and copper are among the preferred metals. Zinc and copper either alone or in combination are especially useful metals. In one embodiment, the lubricant compositions of the invention contain examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin burylate, cobalt hydroxide, nickel hydroxide, nickel carbonate, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^8$ and $R^9$ are derived from secondary alcohols suchk as isopropyl alcohol, secondary butyl alcohol, 2-pentanol, 4-methyl-2-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids.

Useful mixtures of metal salts of dihydrocarbyl dithiophosphoric acid are obtained by reacting phosphorus pentasulfide with a mixture of (a) isopropyl or secondary butyl alcohol, and (b) an alcohol containing at least 5 carbon atoms wherein at least 10 mole percent, preferably 20 or 25 mole percent, of the alcohol in the mixture isopropyl alcohol, secondary butyl alcohol or a mixture thereof.

Thus, a mixture of isopropyl and hexyl alcohols can be used to produce a very effective, oil-soluble metal phosphorodithioate. For the same reason, mixtures of phosphorodithoic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 4-methyl-2-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

The following examples illustrate the preparation of metal phosphorodithioates prepared from mixtures of alcohols.

EXAMPLE B-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times and theoretical amount required to completely neutralize the phosphorodithioic acid. The oil solution of the zinc phosphorodithioate obtained in this manner (10% oil) contains 9.5% phosphorous, 20.0% sulfur and 10.5% zinc.

EXAMPLE B-2

A phosphorodithioioc acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE B-3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm. Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

EXAMPLE B-4

Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-above-prepared phosphorodithioic acid (2287 parts, 6.97 equivalents) is added over a period of about 1.26 hours with an exotherm to 54° C. The mixture is heated to 78° C. and maintained at 75°–85° C. for 3 hours. The reaction mixture is vacuum stripped to 100° C. at 19 mm. Hg. The residue is filtered through a filter aid, and the filtrate is an oil solution (19.2% oil) of the desired zinc salt containing 7.86% zinc, 7.76% phosphorus and 14.8% sulfur.

EXAMPLE B-5

The general procedure of Example B-4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 1 8.05% sulfur.

EXAMPLE B-6

A phosphorodithioic acid is prepared in accordance with the general procedure of Example B-4 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles of zinc oxide with 950.8 parts (3.20 moles) of the above-prepared phosphorodithioic acid. The product prepared in this manner is an oil solution (10% mineral oil) of the desired zinc salt, and the oil solution counting 9.36% zinc, 8.81% phosphorus and 18.65% sulfur.

EXAMPLE B-7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while 15 stirring. The reaction then is maintained at 60°–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

EXAMPLE B-8

A phosphorodithioic acid is prepared by the general procedure of Example B-4 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 mm. Hg., the mixture is filtered twice through a filter aid, and the filtrate is an oil solution (10% mineral oil) of the zinc salt containing 10.06% zinc, 9.04% phosphorus, and 19.2% sulfur.

EXAMPLE B-9

Isopropyl alcohol (410 parts, 6.8 moles) and 590 parts (4.5 moles) 2-ethylhexyl alcohol are charged to a reactor and heated to 50° C. Phosphorus pentasulfide (541 parts, 2.4 moles) is added under a nitrogen sweep. The addition is complete in 1.5 hours at a reaction temperature of from 50–65° C. The contents are stirred for 2 hours and filtered at 55° C. to give the desired phosphorodithioic acid.

A reactor is charged with 145 parts (3.57 equivalents) of zinc oxide and 116 parts oil. Stirring is begun and added is 1000 parts (3.24 equivalents) of the above obtained phosphorodithioc acid over a 1 hour period beginning at room temperature. The addition causes an exotherm to 52° C. The contents are heated to 80° C. and maintained at this temperature for 2 hours. The contents are then vacuum stripped to 100° C. at 22 millimeters mercury. Added is 60 parts oil and the contents are filtered to give the desired product containing 12% oil, 9.5% zinc, 18.5% sulfur and 8.6% phosphorus.

EXAMPLE B-10

Following the procedure of Example B-9, a phosphorodithioic acid is prepared by reacting 1000 parts of an alcohol mixture comprising 46.8% weight isopropyl alcohol and 53.2% weight 4-methyl-2-pentanol, and 642 parts (2.89 moles) phosphorus pentasulfide. To 1000 parts of this acid is added 56 parts diluent oil and 157.5 parts (1.9 moles) zinc oxide. Additional oil is added (28.6 parts) and the contents are filtered to give a product containing 9% oil, 10.0% phosphorus, 11.05% zinc and 21% sulfur.

(C) The Metal Overbased Composition

Metal overbased compositions which are overbased salts of organic acids are widely known to those of skill in the art and generally include metal salts wherein the amount of metal present in them exceeds the stoichoimetric amount. Such salts are said to have conversion levels in excess of 100% (i.e., they comprise more than 100% of the theoretical armount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The overbased salts used as (C) in this invention usually have metal ratios of at least about 3:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, IIA and IIB metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfonic, partial ester sulfuric, sulfurous and thiosulfitric acid. Generally they are salts of carbocylic or aliphatic sulfonic acids.

The carbocylic sulfonic acids include the mono- or polynuclear aromatic or cycloaliphatic compounds. The oil-soluble sulfonates can be represented for the most part by the following formulae:

$$[(R^{11})_x—T—(SO_3)_y]_zM_b \quad \text{(XIV)}$$

$$[R^{12}—(SO_3)_a]_dM_b \quad \text{(XV)}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohoxane, petroleum naphthenes, decahydro-naphthalene, cyclopentane, etc.: $R^{11}$ in Formula XIV is an aliphatic group such as alkyl, alkenyl, alkoxy, alkoxyalkyl, carboalkoxyalkyl, etc.; x is at least 1, and $(R^{11})_x$+T contains a total of at least about 15 carbon atoms, $R^{12}$ in Formula XV is an aliphatic radical containing at least about 15 carbon atoms and M is either a metal cation or hydrogen. Examples of the type of the $R^{12}$ radical are alkyl, alkenyl, alkoxyalkyl, carboalkoxyalkyl, etc. Specific examples of $R^{12}$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^{11}$ and $R^{12}$ in the above formulae can also contain other inorganic or organic substituents in addition to those enumerated above such as, for example, hydroxy, mercapto, halogen, nitro, amino, nitroso, sulfide, disulfide, etc. In Formula XIV, x, y, z and b are at least 1, and likewise in Formula XV, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which as been alkylated with propylene tetramers or isobutene trimers to introduce 1,2,3 or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology," Second Edition, Vol. 11), pp. 291 at seq. published by John Wiley & Sons, N.Y. (1969).

Other descriptions of overbased sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790 and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax stilfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB overbased salts of the above-described synthetic and petroleum sulfonic acids are typically useful in making (B-1) of this invention.

The carboxylic acids from which suitable overbased salts for use in this invention can be made include aliphatic, cycloaliphatic, and aromatic mono- and polybasic carboxylic acids such as the naphenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethyhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil acids, rosin acids and the like.

A typical group of oil-soluble carboxylic acids useful in preparing the salts used in the present invention are the oil-soluble aromatic carboxylic acids. These acids are represented by the general formula:

(XVI)

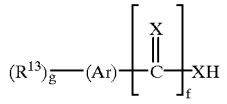

wherein $R^{13}$ is an aliphatic hydrocarbon-based group of at least 4 carbon atoms, and no more than about 400 aliphatic carbon atoms, g is an integer from one to four, Ar is a polyvalent aromatic hydrocarbon nucleus of up to about 14 carbon atoms, each X is independently a sulfur or oxygen atom, and f is an integer of from one to four with the proviso that $R^{13}$ and g are such that there is an average of at least 8 aliphatic carbon atoms provided by the $R^{13}$ groups for each acid molecule represented by the variable Ar are the polyvalent aromatic radicals derived from benzene, napthalene anthracene, phenanthrene, indene, fluorene, biphenyl, and the like. Generally, the radical represented by Ar will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylamino-phenylenes, chlorophenylenes, dipropoxynaphthylenes, triethylnaphthylenes, and similar tri-, tetra-, pentavalent nuclei thereof, etc.

The $R^{13}$ groups are usually hydrocarbyl groups, preferably groups such as alkyl or alkenyl radicals. However, the $R^{13}$ groups can contain small number substituents such as phenyl, cycloalkyl (e.g., cyclohexyl, cyclopentyl, etc.) and non-hydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the $R^{13}$ group is retained. The hydrocarbon character is retained for purposes of this invention so long as any non-carbon atoms present in the $R^{13}$ groups do not account for more than about 10% of the total weight of the $R^{13}$ groups.

Examples of $R^{13}$ groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylenepropylene copolymers, and the like. Likewise, the group $Ar^{13}$ may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

(XVII)

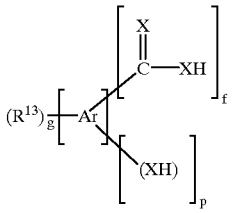

wherein $R^{13}$, X, Ar, f and g are as defined in Formula XVI and p is an integer of 1 to 4, usually 1 or 2. Within this group, an especially preferred class of oil-soluble carboxylic acids are those of the formula:

(XVIII)

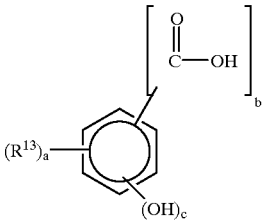

wherein $R^{13}$ in Formula XVIII is an aliphatic hydrocarbon group containing from 4 to about 400 carbon atoms, a is an integer of from 1 to 3, b is 1 or 2, c is zero, 1, or 2 and preferably 1 with the proviso that $R^{18}$ and a are such that the acid molecule contains at least an average of about 12 aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atonms.

The carboxylic acids corresponding to Formulae XVI–XVII above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791, which are incorporated by reference herein for their disclosures of acids and methods of preparing overbased salts.

Another type of overbased carobxylate salt used in making (C) of this invention are those derived from alkenyl succinates of the general formula:

(XIX)

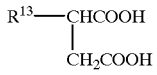

wherein $R^{13}$ is as defined above in Formula XVI. Such salts and means for making them are set forth in U.S. Pat. Nos. 3,271,130; 3,567,637 and 3,632,510, which are hereby incorporated by reference in this regard.

Other patents specifically describing techniques for making overbased salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,296; 3,342,733; 3,320,162; 3,312,618; 3,318,809; 3,471,403; 3,488,284; 3,595,790 and 3,629,109. The disclosures of these patents are hereby incorporated in this present specification for their disclosures in this regard as well as for their disclosure of specific suitable basic metals salts.

In the context of this invention, phenols are considered organic acids. Thus, overbased salts of phenols (generally known as phenates) are also useful in making (C) of this invention are well known to those skilled in the art. The phenols from which these phenates are formed are of the general formula:

$$(R^{13})_g(Ar)—(XH)_f \quad (XX)$$

wherein $R^{13}$, g, Ar, X and f have the same meaning and preferences are described hereinabove with reference to Formula XVI. The same examples described with respect to Formula XVI also apply.

A commonly available class of phenates are those made from phenols of the general formula:

(XXI)

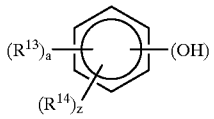

wherein a is an integer of 1–3, b is of 1 or 2, z is 0 or 1, $R^{13}$ in Formula XXI is a hydrocarbyl-based substituent having an average of from 4 to about 400 aliphatic carbon atoms and $R^{14}$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321, which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038, particularly columns 6–8 thereof, which is hereby incorporated by reference for its disclosures in this regard.

Generally Group IIA overbased salts of the above-described carboxylic acids are typically useful in making (C) of this invention.

The method of preparing metal overbased compositions in this manner is illustrated by the following examples.

EXAMPLE C-1

A mixture consisting essentially of 480 parts of a sodium petrosulfonate (average molecular weight of about 480), 84 parts of water, and 520 parts of mineral oil is heated at 100° C. The mixture is then heated with 86 parts of a 76% aqueous solution of calcium chloride and 72 parts of lime (90% purity) at 100° C. for two hours, dehydrated by heating to a water content of less than about 0.5%, cooled to 50° C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The filtrate is found to have a calcium sulfate ash content of 16% and a metal ratio of 2.5. A mixture of 1305 parts of the above carbonated calcium petrosulfonate, 930 parts, of mineral oil, 220 parts of methyl alcohol, 72 parts of isobutyl alcohol, and 3, parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number 32–39. The resulting product is then heated to 155° C. during a period of nine hours to remove the alcohol and filtered at this temperature. The filtrate is characterized by a calcium sulfate ash content of about 40% and a metal ratio of about 12.2.

EXAMPLE C-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol and pentanol) and excess lime (5.6 equivalents per equivalent of the acid). The solution has a sulfur content of 1.7%, a calcium content of 12.6% and a base number of 336. To 950 grams of the solution there is added 50 grams of a polyisobutene (molecular weight of 1000)-substituted succinic anhydride (having a saponification number of 100) at 25° C. The mixture is stirred, heated to 150° C., held at that temperature for 0.5 hour and filtered. The filtrate has a base number of 315 and contains 35.4% of mineral oil.

EXAMPLE C-3

To 950 grams of a solution of a basic, carbonated calcium salt of an alkylated benzene sulfonic acid (average molecular weight—425) in mineral oil (base number—406, calcium—15.2% and sulfur—1.4%) there is added 50 grams of the polyisobutenyl succinic anhydride of Example C-2 at 57° C. The mixture is stirred for 0.65 hour at 55°–57° C., then at 152°–153° C. for 0.5 hour and filtered at 105° C. The filtrate has a base number of 387 and contains 43.7% of mineral oil.

EXAMPLE C-4

A mixture comprising 753 parts by weight of mineral oil, 1440 parts of xylene, 84 parts of a mixture of a commercial fatty acid mixture (acid number of 200, 590 parts of an alkylated benzene sulfonic acid (average molecular weight—500), and 263 parts of magnesium oxide is heated to 60° C. Methanol (360 parts) and water (180 parts) are added. The mixture is carbonated at 65°–98° C. while methanol and water are being removed by azeotropic distillation. Additional water (180 parts) is then added and carbonation is continued at 87°–90° C. for 3.5 hours. Thereafter, the reaction mixture is heated to 160° C. at 20 torr and filtered at 160° C. to give a basic, carbonated magnesium sulfonate-carboxylate complex (78.1% yield) containing 7.69% of magnesium and 1.67% of sulfur and having a base number of 336. To 950 parts of the above basic, carbonated magnesium complex, there is added 50 parts of the polyisobutenyl succinic anhydride of Example C-2 and the mixture is heated to 150° C. for .5 hour and then filtered to give a composition having a base number of 315.

EXAMPLE C-5

A mixture comprising 1000 grams (1.16 equivalents) of an oil solution of an alkylbenzene sulfonic acid, 115 grams of mineral oil, 97 grams of lower alcohols described in Example C-1, 57 grams of calcium hydroxide (1.55 equivalents), and a solution of 3.4 grams $CaCl_2$ in 7 grams water is reacted at a temperature of about 55° C. for about 1 hour. The product is stripped by heating to 165° C. at a pressure of 20 torr and filtered. The filtrate is an oil solution of a basic, carbonated calcium sulfonate complex having a metal ratio of 1.2 and containing 8.0% of calcium sulfate ash, 3.4% of sulfur and a base number of 10.

EXAMPLE C-6

A mixture of 2,576 grams of mineral oil, 240 grams (1.85 equivalents) of octyl alcohol, 740 grams (20.0 equivalents) of calcium hydroxide, 2304 grams (8 equivalents) of oleic acid, and 392 grams (12.3 equivalents) of methyl alcohol is heated with stirring to a temperature about 50° C. in about 0.5 hour. This mixture then is treated with $CO_2$ (3 cubic feet per hour) at 50–60° C. for a period of about 3.5 hours. The resulting mix(ture is heated to 150° C. and filtered. The filtrate is a basic calcium oleate complex having the following analyses: Sulfate ash (%) 24.1; Metal ratio 2.5; and Neutralization No. (acidic) 2.0.

EXAMPLE C-7

A reaction mixture comprising 1044 grams (about 1.5 equivalents) of an oil solution of an alkylphenyl sulfonic acid (average molecular weight—500), 1200 grams of mineral 981, 2400 grams of xylene, 138 grams (about 0.5 equivalents) of tall oil acid mixture (oil-soluble fatty acid mixture sold by Hercules under the name PAMAK-4), 434 grams (20 equivalents) of magnesium oxide, 600 grams of methanol, and 300 grams of water is carbonated at a rate of 6 cubic feet of carbon dioxide per hour at 65°–70° C. (methanol reflux). The carbon dioxide introduction rate was decreased as the carbon dioxide uptake diminished. After 2.5 hours of carbonation, the methanol is removed and by raising the temperature of the mixture to about 95° C. with continued carbon dioxide blowing at a rate of about two cubic feet per hour for one hour. Then 300 grams of water is added to the reaction mixture and carbonation was continued at 90° C. (reflux) for about 4 hours. The material becomes hazy with the addition of the water but clarifies after 2–3 hours of continued carbonation. The carbonated product is then stripped to 160° C. at 20 torr and filtered. The filtrate is a concentrated oil solution (47.5% oil) of the desired basic magnesium salt, the salt being characterized by a metal ratio of about 10.

EXAMPLE C-8

Following the general procedure of Example C-7 but adjusting the weight ratio of methanol to water in the initial reaction mixture to 4:3 in lieu of the 2:1 ratio of Example C-7 another concentrated oil solution (57.5% oil) of a basic magnesium salt is produced. This methanol-water ratio gives improved carbonation at the methanol reflux stage of carbonation and prevents thickening of the mixture during the 90° C. carbonation stage.

EXAMPLE C-9

A mixture of 520 parts of a mineral oil, 480 parts of a sodium petroleum sulfonate (molecular weight of 480) and 84 parts of water is heated to 100° C. and held at this temperature for four hours. Added is 86 parts of a 76% aqueous solution of calcium chloride and 72 parts of calcium hydroxide of a 90% purity. After this addition, the contents are held at 100° C. for 2 hours. The water is then stripped out and at 50° C. added is 130 parts methyl alcohol and the contents are blown with carbon dioxide while at 50° C. until substantially neutral. The mixture is heated to 150° C. to remove the methyl alcohol and water and the resulting oil solution of the basic calcium sulfonate is filtered. The filtrate has a calcium sulfate ash of 16%, a metal ratio of 2.5 and contains 47% oil.

EXAMPLE C-10

Added to a flask: are 835 parts oil, 118 parts of the polyisobutenyl succinic anhydride of Example (C-2, 5.9 parts calcium chloride dissolved in 37 parts water, and 140 parts of a mixture of alcohols comprising 60% isobutyl alcohol and 40% isoamyl alcohol. The contents are stirred and added is 93 parts calcium hydroxide. A synthetic aromatic sulfonic acid (1000 parts, 1.8 equivalents) is slowly added while stirring is continued. The acid is added at a rate which maintains the temperature at below 80° C. Volatiles are removed at 150° C. and the contents are cooled to about 50° C. A dded at this temperature are 127 parts of the aforedescribed mixed alcohols, 277 parts methyl alcohol and 88 parts of the alkylated calcium phenate of Example C-2. The first of three calcium hydroxide additions, 171 parts per addition, is added and the contents are carbonated to a direct base number of 50–60. The fourth addition of 171 parts calcium hydroxide is added and the contents are carbonated to a direct base number of 45–55. Volatiles are distilled and the contents are filtered to give a product containing 41% oil, 300 total base number, 40.7% calcium sulfate ash and 1.8% sulfur.

EXAMPLE C-11

Added to a flask are 600 parts oil, 400 parts of a synthetic sulfonic acid (0.72 equivalents), 771 parts xylene, and 75 parts of the polyisobutenyl succinic anhydride of Example C-2. The contents are heated to 45° C. and the first of three portions of 87 parts of magnesium oxide is added followed by 36 parts of glacial acetic acid. The first of three portions of 31 parts methanol and 59 parts water is added and the contents are carbonated at 48–55° C. The two remaining portions of magnesium oxide, water and methanol are added, followed by carbonation. Volatiles are removed by vacuum stripping. The contents are filtered to give a product containing 32% oil, a 400 total base number, 46% magnesium sulfate ash and 1.6% sulfur.

EXAMPLE C-12

Added to a flask are 2000 parts of a tetrapropene-substituted phenol and 800 parts diluent oil. The contents are stirred and heated to 46° C. and 350 parts sulfur dichloride is added at a rate not to exceed 66° C. By product hydrogen chloride is swept out of the flask using a nitrogen sweep and the gas is vented to a caustic trap. The contents are filtered to give a sulfur coupled alkylphenol.

The above-obtained sulfur coupled alkyl phenol (1000 parts) is added to a flask and stirred. Added is 51 parts calcium hydroxide and the contents are stirred for 0.5 hours. Added is 25.5 parts acetic acid and the temperature rises to 82° C. After cooling to about 60° C., added is 370 parts methyl alcohol, 100 parts diluent oil and 92 parts calcium hydroxide. Carbon dioxide is blown into the contents over a 3 hour period at 52° C. An additional 92 parts calcium hydroxide is added followed by additional carbonation. Volatiles are stripped out and 240 parts oil and 85 parts of the polyisobutenyl succinic anhydride of Example C-2 are added and the contents are filtered to give a product containing 38% oil, 205 total base number, 24.5 calcium sulfate ash and 2.6% sulfur.

EXAMPLE C-13

Added are 1000 parts of the phenol of Example C-12 which is then heated to 99° C. Calcium hydroxide, 89 parts and 70 parts ethylene glycol are added and the temperature is increased to 121–127° C. This is followed by the addition of 181 parts elemental sulfur and the contents are heated to 182–188° C. with nitrogen blowing. The contents are held at this temperature for nine hours and 246 parts oil is added to form an intermediate and 1430 parts of this intermediate are transferred to a carbonator. Added are 55 parts of ethylene glycol, 129 parts decyl alcohol and 70 parts calcium hydroxide are added. The contents are heated to 166–171° C. and held at this temperature while blowing with nitrogen. Oil, 1108 parts, are added and the temperature is increased to 218–224° C. and vacuum stripped to 40 millimeters of mercury. The contents are filtered to give a product having an oil content of 55%, 90 total base number, 11% calcium sulfate ash and 3.5% sulfur.

EXAMPLE C-14

A calcium overbased sulfur coupled alkylphenol similar to that of Example C-13 is prepared by utilizing 1000 parts of the phenol of Example C-12 which is heated to 99° C. Added are 83 parts (2.25 equivalents) of calcium hydroxide and 70 parts ethylene glycol. At 126° C. 160 parts (5 equivalents) of sulfur is added and the temperature is increased to 171° C. and held there for nine hours and 175 parts oil is added. Also added are 150 parts ethylene glycol, 220 parts decyl alcohol and 237 parts (6.42 equivalents) of calcium hydroxide. The temperature is adjusted to 168° C. and held there while blowing with nitrogen for four hours. Then carbon dioxide is blown below the surface until 85 parts is absorbed. The temperature is increased to 220° C. in order to remove volatiles. At 150° C. added is 1073 parts diluent oil and the contents are filtered to give a product having a 200 total base number, 7.2% calcium, 3.45% sulfur and 41% oil.

EXAMPLE C-15

A sodium overbased sulfonic acid is prepared by adding 121 parts of the polyisobutenyl succinic anhydride of Example C-2, 583 parts diluent oil, 84 parts of the phenol of Example C-12 and 417 parts (0.83 equivalents) of an alkyl substituted sulfonic acid to a reaction vessel. The contents are heated and stirred to 49° C. and added is 102 parts of a 50% aqueous solution of sodium hydroxide. The temperature is then increased to 86° C. and held at this temperature for one hour. Four increments of 184 parts (4.61 equivalents) of sodium hydroxide beads are added and each increment is followed with carbon dioxide blowing at 150° C. until 103 parts carbon dioxide is absorbed. Diluent oil, 35 parts, is added and the contents are filtered to give a product containing 31% oil, 448 total base number, 19.45% sodium and 1.2% sulfur.

EXAMPLE C-16

A calcium overbased sulfonic acid is prepared by adding the following to a reaction vessel: 470 parts diluent oil, 92 parts of the polyisobutenyl succinic anhydride of Example C-2, 23 parts acetic acid, 24 parts water and 92 parts (2.5 equivalents) of calcium hydroxide. After stirring for 0.1 hour, 109 parts of the mixture of alcohols of Example C-10 is added followed by 1000 parts (1.4 equivalents) of an alkyl substituted sulfonic acid. The sulfonic acid is added at a rate to maintain the temperature at 75° C. The contents are stripped of volatiles by heating to 150° C. At 49° C., added are an additional 109 parts of the mixture of alcohols, 69 parts of the alkylated calcium phenate of Example C-2 and 216 parts of methyl alcohol. Four increments of 137 parts (3.7 equivalents) of calcium hydroxide are added and each increment is followed with carbon dioxide blowing at about 62° C. The contents are stripped of volatiles at 146° C. and 292 parts oil is added and the contents are filtered to give a product having 42% oil, 300 total base number, 12% calcium and 1.78% sulfur.

Another overbased material is the hydrocarbyl-substituted carboxyalkylene-linked phenols. These materials, in their simple salt form, (i.e., prior to overbasing) can be represented by the, general formula $$A^{y-}M^{y+}$$

wherein M represents one or more metal ions, y is the total valence of all M and A represents one or more anion containing groups having a total of about y individual anionic moieties.

Methods for preparing this type of overbased material are well known in the art and need not be illustrated in further detail here. For example, see U.S. Pat. No. 5,356,546, which is hereby incorporated by reference for its disclosure of the preparation of this overbased material.

(D) The Borate Ester

The borate ester is of the formula

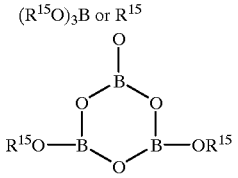

wherein $R^{15}$ is independently hydrogen or a hydrocarbyl group containing from 2 to about 24 carbon atoms, with the proviso that at least one $R^{15}$ is the hydrocarbyl group. Preferably, $R^{15}$ is an aliphatic group containing from 4 to about 16 carbon atoms and most preferably all the $R^{15}$ groups are aliphatic groups. The $(R^{15}O)_3B$ is the most preferred borate ester.

An illustrative, but non-exhaustive list of trihydrocarbyl borates are as follows: triethyl borate, tripropyl borate, triisopropyl borate, tributyl borate, tripentyl borate, trihexyl borate, tricyclohexyl borate, trioctyl borate, triisooctyl borate, tridecyl borate, tri ($C_{8-10}$) borate, tri ($C_{12-15}$ borate) and oleyl borate.

The most preferred borate ester of the formula $(R^{15}O)_3B$ is prepared by reacting 3 moles of alcohol $R^{15}OH$ with 1 mole of orthoboric acid $H_3BO_3$. The reaction conditions are conducted at a temperature of above 100° C. in order to remove 3 moles of water.

The borate ester of the fonnula

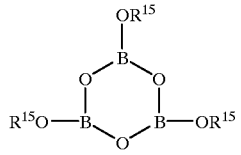

is prepared by reacting 1 mole of alcohol $R^{15}OH$ with 1 mole of orthoboric acid $H_3BO_3$. Again, the reaction temperature is above 100° C. in order to remove 1 mole of water.

The composition of this invention comprises an admixture of a major amount of oil and a minor amount of components (A), (B), (C) and (D) with the proviso that the borate ester and the borated dispersant provide from 20 to about 800 parts per million (ppm) mass of boron in the above composition. Preferably, the borate ester and the borated dispersant provide from 60 to about 600 ppm (mass) of boron and most preferably from 80 to about 500 ppm (mass) of boron. The following states the weight ratio ranges of components (A), (B) and (C) on an oil-free basis.

| Component | Generally | Preferred | Most Preferred |
|---|---|---|---|
| (A) | 1–10 | 2–8 | 3–5 |
| (B) | 0.5–4 | 0.75–3 | 1–1.5 |
| (C) | 0.5–6 | 0.75–4 | 1–3 |

As stated above, component (D) is present with components (A), (B) and (C) such that the total ppm (mass) of boron is from 20 to about 800 and preferably from 60 to about 600 ppm and most preferably from 80 to about 500 ppm (mass) of boron. It is understood that other components besides (A), (B), (C) and (D) may be present within the composition of this invention. An especially preferred component includes an anti-foaming agent. Since the lubricant composition of this invention is generally subjected to substantial mechanical agitation and pressure, the inclusion of an anti-foaming agent is highly desirable in order to reduce and/or eliminate foaming. This foaming could create problems with the mechanical operations of the device with which the lubricant composition is used. The anti-foaming agent is generally present in an amount of from about 0.001 to about 0.2 parts by weight based on the weight of the lubricant composition. Useful anti-foaming agents are a commercial dialkyl siloxane polymer or a polymer of an alkyl methacrylate.

The term "major amount" as used in the specification and appended claims is intended to mean that when a composition contains a "major amount" of a specific material, that amount is more than 50 percent by weight of the composition.

The term "minor amount" as used in the specification and appended claims is intended to mean that when a composition contains a "minor amount" of a specific material, that amount is less than 50 percent by weight of the composition.

Order of addition is of no consequence when combining the components of this invention. The oil with components (A), (B) and (C), along with other components may be preblended and component (D) may be added and mixed as a top treatment. Alternatively, components (A) and (D) may be premixed and then combined with oil, components (B), (C) and other components. Regardless the order of the components, they are blended together according to the above ranges to effect solution.

To establish the effectiveness of this invention, the inventive composition of oil and components (A), (B), (C) and (D), along with other components, are blended together to give an inventive test formulation. This inventive test formulation is measured against a baseline formulation. The baseline formulation contains all the components of the test Formulation but for component (D). The measure of the (A), (B) and (C) components is on an oil-free basis. Both the inventive test formulation and the baseline formulation are considered to be fully formulated engine lubricants. These formulations are evaluated to determine their tendency to corrode lead and copper containing alloys commonly used in engine oils.

Copper and lead test pieces are cleaned, polished and suspended in a test tube containing a sample of either the baseline formulation or the inventive composition formulation. The sample is maintained at 135° C. for 216 hours with air bubbling through the sample at 50 cubic centimeters per minute. At the end of the test, the metal pieces are removed and the samples are submitted for spectrographic analyses to determine the levels of copper and lead in the oil. Measurements of the metal before and after testing determine the change in weight of the test pieces. A high value of copper and lead in the sample (measured as ppm) at the end of the test signifies that the sample attacked, dissolved or interacted with the test piece.

Many commercial formulations contain borated dispersants to protect against lead/copper corrosion and to provide better antiwear performance. However, many of these formulations still produce considerable lead corrosion both in corrosion bench tests and in engines. In the bench test data that follows, some formulations containing borated dispersants produced significant lead corrosion. When a borated ester is added to the borated dispersant formulation, the lead corrosion was greatly reduced.

In the examples of the following table, Example 1 is to be compared to Baseline A, the baseline for Example 1, Example 2 is to be compared to Baseline B, the baseline of Example 2, Example 3 is to be compared to Baseline C, the baseline for Example 3, etc.

Lead/Copper Corrosion Test

| EXAMPLE | (A) | (B) | (C) | (D) | Total ppm boron | Pb (ppm) | Cu (ppm) |
|---|---|---|---|---|---|---|---|
| A | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Examples C-11 | None | 277 | 85 | 122 |
| 1 | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11 | 0.18 parts tri $C_5$ borate | 380 | 0 | 46 |
| B | 2.91 parts product of Example A-25<br>1.8 parts product of Example A-26 | 1.18 parts product of Example B-9<br>0.79 parts product of Example B-10 | 0.35 parts product of Example C-14<br>0.27 parts product of Example C-16<br>1.72 parts product of Example C-9<br>0.34 parts product of Example C-11 | None | 277 | 15 | 225 |
| 2 | 2.91 parts product of Example A-25<br>1.8 parts product of Example A-26 | 1.18 parts product of Example B-9<br>0.79 parts product of Example B-10 | 0.35 parts product of Example C-14<br>0.27 parts product of Example C-16<br>1.72 parts product of Example C-9<br>0.34 parts product of Example C-11 | 0.18 parts tri $C_5$ borate | 388 | 0 | 248 |
| C | 2.91 parts product of Example A-25<br>1.8 parts product of Example A-26 | 1.18 parts product of Example B-9<br>1.01 parts product of Example B-10 | 0.35 parts product of Example C-14<br>0.27 parts product of Example C-16<br>1.72 parts product of Example C-9<br>0.34 parts product of Example C-11 | None | 244 | 12 | 9 |
| 3 | 2.91 parts product of Example A-25<br>1.8 parts product of Example A-26 | 1.18 parts product of Example B-9<br>1.01 parts product of Example B-10 | 0.35 parts product of Example C-14<br>0.27 parts product of Example C-16<br>1.72 parts product of Example C-9<br>0.34 parts product of Example C-11 | 0.18 parts tri $C_5$ borate | 375 | 0 | 5 |
| D | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11<br>0.1 parts product of Example C-15 | None | 244 | 47 | 44 |
| 4 | 2.91 parts product of Example A-25 | 1.18 parts product of Example B-9 | 0.35 parts product of Example C-14<br>0.27 parts product of Example C-16<br>1.72 parts product of Example C-9 | 0.18 parts tri $C_5$ borate | 387 | 5 | 15 |

-continued

Lead/Copper Corrosion Test

| EXAMPLE | (A) | (B) | (C) | (D) | Total ppm boron | Pb (ppm) | Cu (ppm) |
|---|---|---|---|---|---|---|---|
| | 1.8 parts product of Example A-26 | | 0.34 parts product of Example C-11<br>0.1 parts product of Example C-15 | | | | |
| E | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11 | None | 242 | 35 | 31 |
| 5 | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11 | 0.18 parts tri $C_5$ borate | 394 | 0 | 109 |
| F | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11<br>0.1 parts product of Example C-15 | None | 216 | 28 | 16 |
| 6 | 2.91 parts product of Example A-25<br>1.8 parts product of Example A-26 | 1.18 parts product of Example B-9 | 0.35 parts product of Example C-14<br>0.27 parts product of Example C-16<br>1.72 parts product of Example C-9<br>0.34 parts product of Example C-11<br>0.1 parts product of Example C-15 | 0.18 parts tri $C_5$ borate | 383 | 0 | 7 |

While the invention has been explained in relation to its preferred embodiments, it is to be understood that various modifications thereof will become apparent to those skilled in the art upon reading the disclosure. Therefore, it is to be understood that the invention disclosed herein is intended to cover such modifications as fall within the scope of the appended claims.

What is claimed is:

1. A composition for reducing the copper-lead bearing corrosion of a formulation that includes a major amount of an oil of lubrication viscosity and a minor amount of a corrosion-reducing additive comprising (A) a borated dispersant with a total base number of from 20 to 160 on an oil-free basis;

(B) a metal salt of a phosphorus acid; and (C) a metal overbased composition comprising at least one carboxylate, phenate, or sulfonate wherein the metal is lithium, sodium, potassium, magnesium or calcium, and wherein the improvement comprises (D) a borate ester wherein the borate ester and borated dispersant provide 20 to about 800 ppm (mass) boron.

2. The composition of claim 1 wherein the dispersant is a Mannich reaction product of at least one phenol containing at least one aliphatic substituent with formaldehyde and an amino compound wherein the dispersant has a total base number of not more than 100 on an oil-free basis.

3. The composition of claim 2 wherein the substituent is an aliphatic substituent having at least 30 carbon atoms.

4. The composition of claim 2 wherein the substituent on the phenol is a substantially saturated hydrocarbyl group having an average of 50 to 7000 carbon atoms.

5. The composition of claim 2 wherein the amino compound is an alkylene polyamine.

6. The composition of claim 2 wherein the amino compound is ethylene polyamine.

7. The composition of claim 1 wherein the dispersant is a reaction product of a hydrocarbyl-substituted succinic acylating agent, and at least one of (a) ammonia or (b) an amine.

8. The composition of claim 7 wherein the hydrocarbyl group contains an average of from about 40 to about 500 carbon atoms.

9. The composition of claim 7 wherein the hydrocarbyl group contains an average of from about 50 to about 300 carbon atoms.

10. The composition of claim 7 wherein the hydrocarbyl group is derived from a polyalkene having a number average molecular weight of from at least about 800.

11. The composition of claim 7 wherein the hydrocarbyl group is derived from a polyalkene having a number average molecular weight of from at least about 1500 to 5000.

12. The composition of claim 7 wherein the hydrocarbyl group is derived from a polyolefin.

13. The composition of claim 7 wherein the hydrocarbyl group is derived from a polybutene, polypropylene or mixtures thereof.

14. The composition of claim 7 wherein the hydrocarbyl group is an ethylene/alpha olefin based polymer.

15. The composition of claim 7 wherein the hydrocarbyl group is derived from a polyalkene having a number average molecular weight of from about 1500 to about 5000, and wherein the number of equivalents of succinic groups to the number of equivalents of hydrocarbyl groups is at least about 1.3.

16. The composition of claim 7 wherein the hydrocarbyl substituted succinic acylating agent is reacted with an amine comprising a monoamine or a polyamine wherein the dispersant has a total base number of at least 40 on an oil-free basis.

17. The composition of claim 16 wherein the amine is a monoamine containing alkyl groups, each independently containing from 1 to about 30 carbon atoms.

18. The composition of claim 16 wherein the amine is a polyalkylene polyamine or a condensed polyamine.

19. The composition of claim 16 wherein the amine is a hydroxyamine.

20. The composition of claim 16 wherein the amine comprises monoethanolamine, dliethanolamine, triethanolamine, dimethylethanolamine, diethylethanolamine, dimethylaminopropanol, diethylaminopropanol, or aminopropanol.

21. The composition of claim 1 wherein the metal salt of the phosphorus acid is of the formula

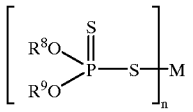

wherein $R^8$and $R^9$ are each independently hydrocarbyl groups containing from 3 to about 30 carbon atoms and M is a metal and n is an integer equal to the valence of M.

22. The composition of claim 21 wherein the hydrocarbyl groups comprise alkyl, cycloalkyl, aralkyl, or alkaryl groups.

23. The composition of claim 21 wherein the hydrocarbyl groups are alkyl groups that contain up to 13 carbon atoms.

24. The composition of claim 21 wherein the metal M comprises Group I metals, Group II metals, aluminum, lead, tin, manganese, cobalt, nickel, copper or mixtures thereof.

25. The composition of claim 21 wherein the metal M comprises zinc, copper or mixtures thereof.

26. The composition of claim 21 wherein the metal salt of the phosphorus acid is prepared by reacting phosphorus pentasulfide with an alcohol mixture comprising at least 10 mole percent of isopropyl alcohol, secondary butyl alcohol, or a mixture of isopropyl and secondary butyl alcohols, and at least one primary aliphatic alcohol containing from about 3 to about 13 carbon atoms.

27. The composition of claim 1 wherein the metal overbased composition is a metal overbased sulfonate derived from an alkylated aryl sulfonic acid wherein the alkyl group has at least 15 aliphatic carbon atoms.

28. The composition of claim 1 wherein the metal overbased composition is a metal overbased carboxylate derived from a fatty acid having at least 8 aliphatic carbon atoms.

29. The composition of claim 1 wherein the metal overbased composition is a metal overbased phenate derived from the reaction of an alkylated phenol wherein the alkyl group has at least 6 aliphatic carbon atoms with formaldehyde.

30. The composition of claim 29 wherein the phenate is derived from the reaction of an alkylatcd phenol wherein the alkyl group has at least 6 aliphatic carbon atoms with a sulfurization agent.

31. The composition of claim 29 wherein the phenate is derived from the reaction of an alkylated phenol having at least 6 aliphatic carbon atoms with a sulfurization agent and formaldehyde.

32. The composition of claim 1 wherein the metal overbased composition is a metal overbased salicylate derived from an alkylated salicylic acid of the formula

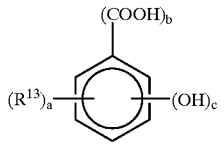

wherein $R^{13}$ is an aliphatic hydrocarbon based group containing from 4 to 400 carbon atoms, a is an in teger of from 1 to 3, b is 1 or 2, and c is zero, 1 or 2 with the proviso that $R^{13}$ and a are such that the acid molecule contains at least an average of about 12 aliphatic carbon atoms.

33. The composition of claim 1 wherein the borate ester is of the formula

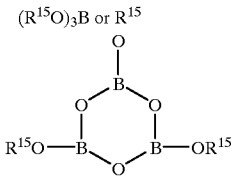

wherein $R^{15}$ is independently hydrogen or a hydrocarbyl group containing from 2 to about 24 carbon atoms, with the proviso that at least one $R^{15}$ is the hydrocarbyl group.

34. The composition of claim 33 wherein $R^{15}$ is an aliphatic group containing from 4 to about 16 carbon atoms.

35. The composition of claim 1 wherein the borate ester and borated dispersant provide 60 to about 600 ppm (mass) boron.

36. The composition of claim 1 wherein the borate ester and borated dispersant provide 80 to about 500 ppm (mass) boron.

* * * * *